US011769972B2

(12) United States Patent
Nakamura et al.

(10) Patent No.: US 11,769,972 B2
(45) Date of Patent: Sep. 26, 2023

(54) COAXIAL CONNECTOR DEVICE

(71) Applicant: I-PEX Inc., Kyoto (JP)

(72) Inventors: Hiroki Nakamura, Machida (JP); Takao Yamauchi, Machida (JP); Ichiro Sugiura, Machida (JP); Li Yao Lin, Machida (JP)

( * ) Notice: Subject to any disclaimer, the term of this patent is extended or adjusted under 35 U.S.C. 154(b) by 0 days.

(21) Appl. No.: 17/475,347

(22) Filed: Sep. 15, 2021

(65) Prior Publication Data

US 2022/0006245 A1 Jan. 6, 2022

Related U.S. Application Data

(63) Continuation of application No. PCT/JP2020/008183, filed on Feb. 27, 2020.

(30) Foreign Application Priority Data

Mar. 18, 2019 (JP) ..... 2019-050505

(51) Int. Cl.
*H01R 24/40* (2011.01)
*H01R 12/75* (2011.01)
*H01R 103/00* (2006.01)

(52) U.S. Cl.
CPC ..... *H01R 24/40* (2013.01); *H01R 12/75* (2013.01); *H01R 2103/00* (2013.01)

(58) Field of Classification Search
CPC .. H01R 2103/00; H01R 24/40; H01R 9/0518; H01R 12/75
USPC ..... 439/578, 582
See application file for complete search history.

(56) References Cited

U.S. PATENT DOCUMENTS

2002/0155755 A1 10/2002 Yamane
2005/0136701 A1 6/2005 Ikeda
2012/0295477 A1* 11/2012 Funahashi ..... H01R 24/545 439/578
2012/0322304 A1 12/2012 Taguchi
(Continued)

FOREIGN PATENT DOCUMENTS

CN 2501194 7/2002
CN 101834391 9/2010
(Continued)

OTHER PUBLICATIONS

International Search Report dated Apr. 14, 2020 for PCT/JP2020/008183.
(Continued)

*Primary Examiner* — Gary F Paumen
(74) *Attorney, Agent, or Firm* — SOEI PATENT & LAW FIRM

(57) ABSTRACT

A signal contact member and a ground contact member to which a center conductor and an outer conductor of a coaxial cable are connected are supported by an insulating housing member. The ground contact member has an annular fitting portion that fits and connects to the ground contact portion of a mate connector device. The annular fitting portion is provided with an opening for disposing a center conductor connection portion of the signal contact member. A shell portion of a ground contact member or an insulating housing member is provided with a conductive member given a ground potential. The conductive member partially fills the opening in the annular fitting portion.

20 Claims, 38 Drawing Sheets

(56) References Cited

U.S. PATENT DOCUMENTS

| | | | | |
|---|---|---|---|---|
| 2013/0149897 | A1* | 6/2013 | Takano | H01R 12/718 439/582 |
| 2013/0280948 | A1 | 10/2013 | Tsuchida et al. | |
| 2014/0106581 | A1 | 4/2014 | Hashiguchi | |
| 2018/0212363 | A1 | 7/2018 | Fukumoto et al. | |
| 2019/0260168 | A1 | 8/2019 | Okada et al. | |

FOREIGN PATENT DOCUMENTS

| | | |
|---|---|---|
| CN | 102725921 | 10/2012 |
| CN | 103427256 | 12/2013 |
| CN | 103779745 | 5/2014 |
| CN | 109891685 | 6/2019 |
| JP | H9-120870 | 5/1997 |
| JP | 2001-043939 | 2/2001 |
| JP | 2005-183212 | 7/2005 |
| JP | 3191979 | 7/2014 |
| JP | 2016-195087 | 11/2016 |
| JP | 2018-116908 | 7/2018 |
| WO | 2011/121855 | 10/2011 |
| WO | 2018/083923 | 5/2018 |

OTHER PUBLICATIONS

International Preliminary Report on Patentability with Written Opinion dated Sep. 30, 2021 for PCT/JP2020/008183.

* cited by examiner

COAXIAL CONNECTOR DEVICE

CROSS-REFERENCE TO RELATED APPLICATIONS

This application is a continuation application of PCT Application No. PCT/JP2020/008183, filed on Feb. 27, 2020, which claims the benefit of priority from Japanese Patent Application No. 2019-050505, filed on Mar. 18, 2019, the entire contents of which are incorporated herein by reference.

BACKGROUND

1. Field

The present disclosure relates to a coaxial connector device. The coaxial connector device includes a signal contact member and a ground contact member insulated from each other, and is connected to a mate connector device, which is another connector device. A center conductor and an outer conductor of a coaxial cable are connected to the signal contact member and the ground contact member, respectively, which are insulated from each other. The coaxial cable is configured such that the center conductor and the outer conductor surrounding the center conductor via an internal insulator are covered with an external insulator.

2. Description of the Related Art

Coaxial cables are often used to transmit radio frequency signals between a plurality of electrical components, electrical devices, or electronic devices. The coaxial cable is configured such that a center conductor and an external conductor surrounding the center conductor via an internal insulator are covered with an external insulator. The center conductor and the external conductor surrounding the center conductor via the internal insulator form a signal transmission path that is not easily affected by external noise. For example, the coaxial cable is connected to a circuit board that handles radio frequency signals. A radio frequency signal is transmitted from the circuit board to the outside through a coaxial cable, or a radio frequency signal is transmitted from the outside to the circuit board through the coaxial cable.

When the coaxial cable is connected to the circuit board, a coaxial connector device is attached to one end of the coaxial cable, and the coaxial connector device is mechanically and electrically connected to a mate connector device. The coaxial connector device includes a signal contact member to which a center conductor of the coaxial cable is connected and a ground contact member to which an outer conductor of the coaxial cable is connected. The mate connector device includes a signal contact portion and an annular ground contact portion, and is attached to the circuit board. A radio frequency signal handled in the circuit board is supplied to the signal contact portion. The annular ground contact portion is disposed to surround the signal contact portion and is provided with a ground potential. Thus, for example, the ground contact member of the coaxial connector device is fitted and connected to the annular ground contact portion of the mate connector device, the signal contact member of the coaxial connector device is contacted and connected to the signal contact portion of the mate connector device, and the coaxial connector device is mechanically and electrically coupled to the mate connector device.

The coaxial connector device is connected to the mate connector device as follows. The mate connector device attached to the circuit board is positioned, for example, with its signal contact portion and annular ground contact portion facing above the component mounting surface of the circuit board. The coaxial connector device mounted on one end of the coaxial cable is engaged with the mate connector device in a direction from above the component mounting surface of the circuit board toward the component mounting surface. The ground contact member of the coaxial connector device is fitted and connected to the annular ground contact portion of the mate connector device, and the signal contact member of the coaxial connector device is contacted and connected to the signal contact portion of the mate connector device. Therefore, on the circuit board to which the mate connector device is attached, the coaxial connector device protrudes from the component mounting surface on the circuit board.

As described above, as a coaxial connector device mounted on one end of a coaxial cable and connected to a mate connector device attached to a circuit board, for example, a coaxial connector device disclosed in Japanese Unexamined Patent Application Publication No. 2005-183212 has been proposed.

The coaxial connector device (coaxial connector (10)) disclosed in Japanese Unexamined Patent Application Publication No. 2005-183212 is configured such that a signal contact member (terminal (13)) and a ground contact member (external conductor (11)) are held in a mutually insulated state by an insulating housing member (dielectric (12)). The signal contact member (terminal (13)) has a center conductor connection portion (connection portion (24)) to which a center conductor (core wire (C1)) of the coaxial cable (cable (C)) is connected. The ground contact member (outer conductor (11)) is connected to the outer conductor (shield line (C2)) of the coaxial cable. A mate connector device (mating connector (60)) to which the coaxial connector device is connected is configured such that a signal contact portion (center conductor (62)) and a ground contact portion (outer conductor (61)) are held in an insulated state by an insulating housing member (dielectric (63)). The signal contact portion (center conductor (62)) is connected to a signal terminal portion in a circuit board. The ground contact portion (outer conductor (61)) surrounds the contact connection portion (contact portion (62A)) of the signal contact portion.

The annular fitting portion (fitting cylindrical portion (14)) of the ground contact member of the coaxial connector device is formed by bending a metal plate into an annular shape. The annular fitting portion (fitting cylindrical portion (14)) has a pair of openings (14A). The pair of openings (14A) are disposed to face each other and form an opening for disposing a center conductor connection portion of the signal contact member to which the center conductor of the coaxial cable is connected. A pair of arm portions (15) extend from the pair of open portions (14A), respectively. The pair of arm portions (15) face each other with the center conductor of the coaxial cable therebetween.

In addition, the ground contact member of the coaxial connector device has a shell portion (a lid portion (16)) bent and extended from one end of the annular fitting portion. The shell portion is provided with a first clamping portion (surrounding portion (17)) and a second clamping portion (holding portion (20)). The first clamping portion (the surrounding portion (17)) and the second clamping portion (the holding portion (20)) clamp the coaxial cable in which the center conductor is connected to the center conductor connection portion of the signal contact member. The first clamping portion wraps the pair of arm portions (15) from the outside to clamp the coaxial cable. Accordingly, the coaxial cable with the center conductor connected to the center conductor connection portion of the signal contact member is secured to the coaxial connector device.

Further, the insulating housing member of the coaxial connector device has a main body (21) disposed inside the annular fitting portion of the ground contact member. The main body (21) is disposed inside the annular fitting portion of the ground contact member. A through hole (hole (21A)) is formed at the center of the main body 21, and a contact connection portion (contact portion (25)) of the signal contact member is disposed in the through hole.

Thus, when the coaxial connector device is connected to the mate connector device, the annular fitting portion of the ground contact member of the coaxial connector device is fitted and connected to the ground contact portion of the mate connector device. The contact connection portion of the signal contact member of the coaxial connector device is contacted and connected to the signal contact portion of the mate connector device. The ground contact member of the coaxial connector device and the ground contact portion of the mate connector device are each provided with a ground potential.

SUMMARY

In the coaxial connector device, the coaxial connector device is connected to the mate connector device, and the annular fitting portion of the ground contact member is fitted and connected to the ground contact portion of the mate connector device. There is a gap between the opening formed in the annular fitting portion of the ground contact member and the first clamping portion of the shell portion of the ground contact member. The contact connection portion of the signal contact member is disposed in the through hole formed in the central portion of the main body of the insulating housing member. A radio frequency signal is transmitted to the contact connection portion of the signal contact member disposed in the main body of the insulating housing member. The main body faces the outside of the coaxial connector device through the opening and the gap without interposing the conductive member provided with a ground potential. Therefore, in the coaxial connector device proposed in the related art, the radio frequency signal leaks to the outside of the coaxial connector device through the opening and the gap to cause noise interference with other electronic components, electronic devices, and the like.

A coaxial connector device includes a signal contact member, a ground contact member, and an insulating housing member supporting the signal contact member and the ground contact member in an insulated state, and is connected to a mate connector device. A center conductor of a coaxial cable is connected to the signal contact member. An outer conductor of the coaxial cable is connected to the ground contact member. The ground contact member has an annular fitting portion that is fitted and connected to the ground contact portion of the mate connector device, and an opening is provided in the annular fitting portion. In the opening, a center conductor connection portion of the signal contact member to which the center conductor of the coaxial cable is connected or a center conductor of the coaxial cable connected to the center conductor connection portion of the signal contact member is disposed. To provide a coaxial connector device capable of reducing leakage of a radio frequency signal through a signal contact member to the outside through an opening of an annular fitting portion of a ground contact member.

A coaxial connector device according to a present disclosure (hereinafter referred to as a coaxial connector device according to the present disclosure) is a coaxial connector device that includes a signal contact member; a ground contact member configured to be provided with a ground potential; and an insulating housing member supporting the signal contact member and the ground contact member in an insulated state. The signal contact member includes: a center conductor connection portion configured to be connected to a center conductor of a coaxial cable; and a contact connection portion configured to be contacted and connected to a signal contact portion of a mate connector device mounted on a circuit board. The ground contact member includes: an annular fitting portion configured to be fitted and connected to the ground contact portion of the mate connector device; and a shell portion foldably extending (or flexibly extending) from the annular fitting portion and configured to be connected to an outer conductor of the coaxial cable having the center conductor connected to the center conductor connection portion. The annular fitting portion of the ground contact member is provided with an opening which accommodates one or both of a center conductor connection portion of the signal contact member to which the center conductor of the coaxial cable is connected or the center conductor of the coaxial cable connected to the center conductor connection portion of the signal contact member. The shell portion of the ground contact member or the insulating housing member is provided with a conductive member configured to: be provided with a ground potential; and partially fill the opening provided in the annular fitting portion.

In the coaxial connector device according to the present disclosure, the opening is provided in the annular fitting portion of the ground contact member to which the ground potential is applied. The center conductor connection portion of the signal contact member to which the center conductor of the coaxial cable is connected or the center conductor of the coaxial cable connected to the center conductor connection portion of the signal contact member is disposed in the opening. A conductive member partially filling the opening is provided in the shell portion of the ground contact member or in the insulating housing member. The conductive member is provided with a ground potential. The coaxial connector device according to the present disclosure is connected to a mate connector device mounted on a circuit board. The contact connection portion of the signal contact member is contacted and connected to the signal contact portion of the mate connector device mounted on the circuit board. At the same time, the annular fitting portion of the ground contact member is fitted and connected to the ground contact portion of the mate connector device mounted on the circuit board. In this state, the conductive member provided with the ground potential partially fills the opening provided in the annular fitting portion.

For example, a clamping portion is provided in a shell portion of the ground contact member. The clamping portion clamps a coaxial cable having a center conductor connected to the center conductor connection portion of the signal contact member. The conductive member is integrally formed with the clamping portion. Alternatively, the conductive member is provided separately from the shell portion of the ground contact member and is secured to the insulating housing member.

The coaxial connector device according to the present disclosure is connected to the mate connector device mounted on the circuit board. The contact connection portion of the signal contact member is contacted and connected to the signal contact portion of the mate connector device mounted on the circuit board. The annular fitting portion of the ground contact member provided with the ground potential is fitted and connected to the ground contact portion of the mate connector device mounted on the circuit board. In this state, the conductive member provided with the ground potential partially fills the opening provided in the annular fitting portion. Therefore, according to the coaxial connector device of the present disclosure, leakage of a radio frequency signal through the signal contact member to the outside through the opening of the annular fitting portion of the ground contact member may be reduced.

DETAILED DESCRIPTION

Figure 1:
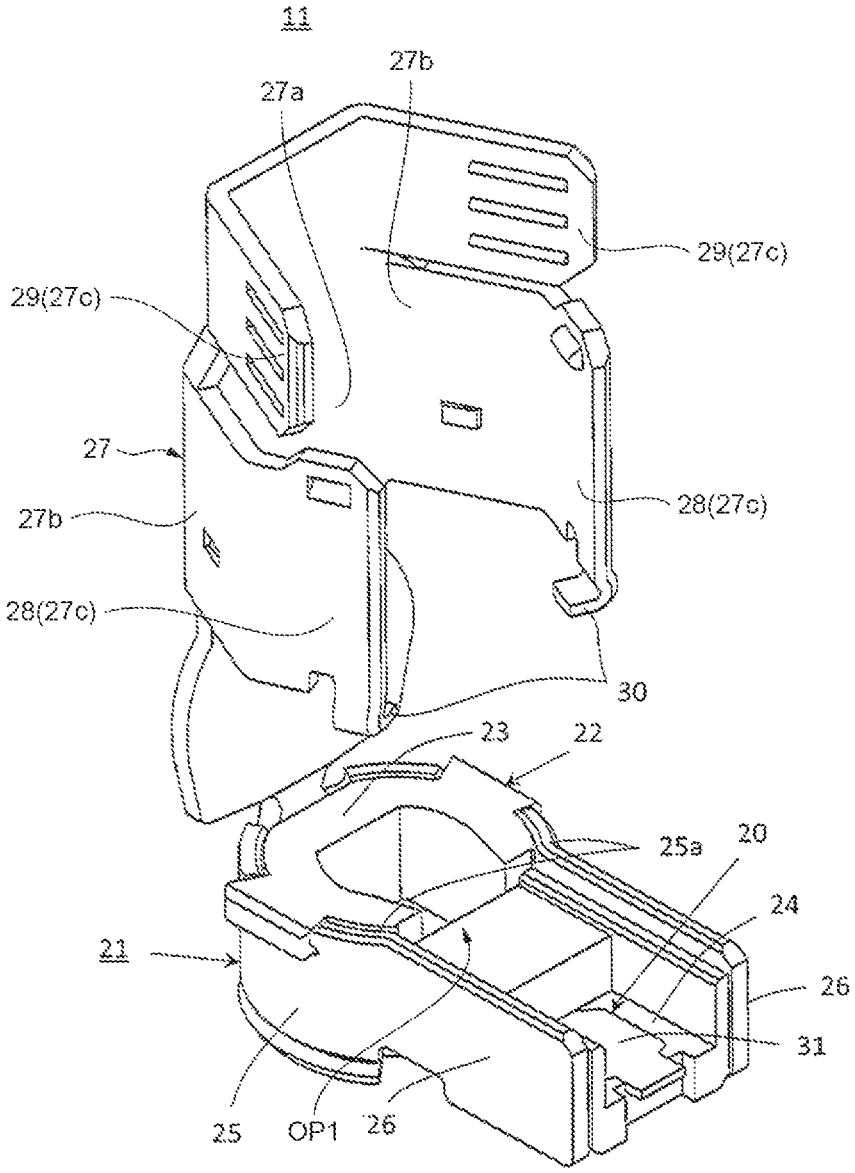
FIG. 1 is a perspective view illustrating an example coaxial connector device according to the present disclosure.

Hereinafter, with reference to the drawings, the same elements or similar elements having the same function are denoted by the same reference numerals, and redundant description will be omitted.

FIG. 1 illustrates a coaxial connector device 11 constituting an example coaxial connector device according to the present disclosure. The coaxial connector device 11 illustrated in FIG. 1 is attached to one end of a coaxial cable. The coaxial cable to which the coaxial connector device 11 is attached at one end is illustrated as a coaxial cable 12 in FIG. 2 to be described later. The coaxial cable 12 includes a center conductor 13, an internal insulator 14 closely surrounding the center conductor 13, an outer conductor 15 closely surrounding the internal insulator 14, and a surface insulator 16 closely surrounding the outer conductor 15. The coaxial connector device 11 is attached to one end of the coaxial cable 12. At this end, the surface insulator 16 is partially excised to expose the outer conductor 15, and each of the outer conductor 15 and the internal insulator 14 is partially excised to expose the center conductor 13.

The coaxial connector device 11 includes a signal contact member 20, a ground contact member 21, and an insulating housing member 22 as main constituent element. The signal contact member 20 is formed of an elastic conductive material and is electrically connected to the center conductor 13 of the coaxial cable 12. The ground contact member 21 is formed of an elastic conductive material and is electrically connected to the outer conductor 15 of the coaxial cable 12. The insulating housing member 22 is formed of an insulating material such as a synthetic resin material, and supports the signal contact member 20 and the ground contact member 21 in a mutually insulated state.

The insulating housing member 22 includes a cylindrical portion 23 and a center conductor support 24. The cylindrical portion 23 holds the signal contact member 20. The center conductor support 24 extends from the cylindrical portion 23 and supports the center conductor 13 of the coaxial cable 12 connected to the signal contact member 20, via the signal contact member 20.

The ground contact member 21 has an annular fitting portion 25 that partially surrounds the cylindrical portion 23 of the insulating housing member 22. An opening OP1 is formed in the annular fitting portion 25. The opening OP1 is sandwiched by a pair of ends 25*a* of the annular fitting portion 25 that face each other. From the pair of ends 25*a*, a pair of arm portions 26 extends along the center conductor support 24 of the insulating housing member 22. The pair of arm portions 26 face each other across the center conductor support 24. The cylindrical portion 23 of the insulating housing member 22 and the annular fitting portion 25 of the ground contact member 21 partially surrounding the cylindrical portion 23 constitute a fitting connection portion in the coaxial connector device 11. The coaxial connector device 11 mounted at one end of the coaxial cable 12 is fitted and connected to a mate connector device, which is another connector device, by the fitting connection portion. At this time, the annular fitting portion 25 is fitted and connected to a ground contact portion of the mate connector device.

Figure 5:
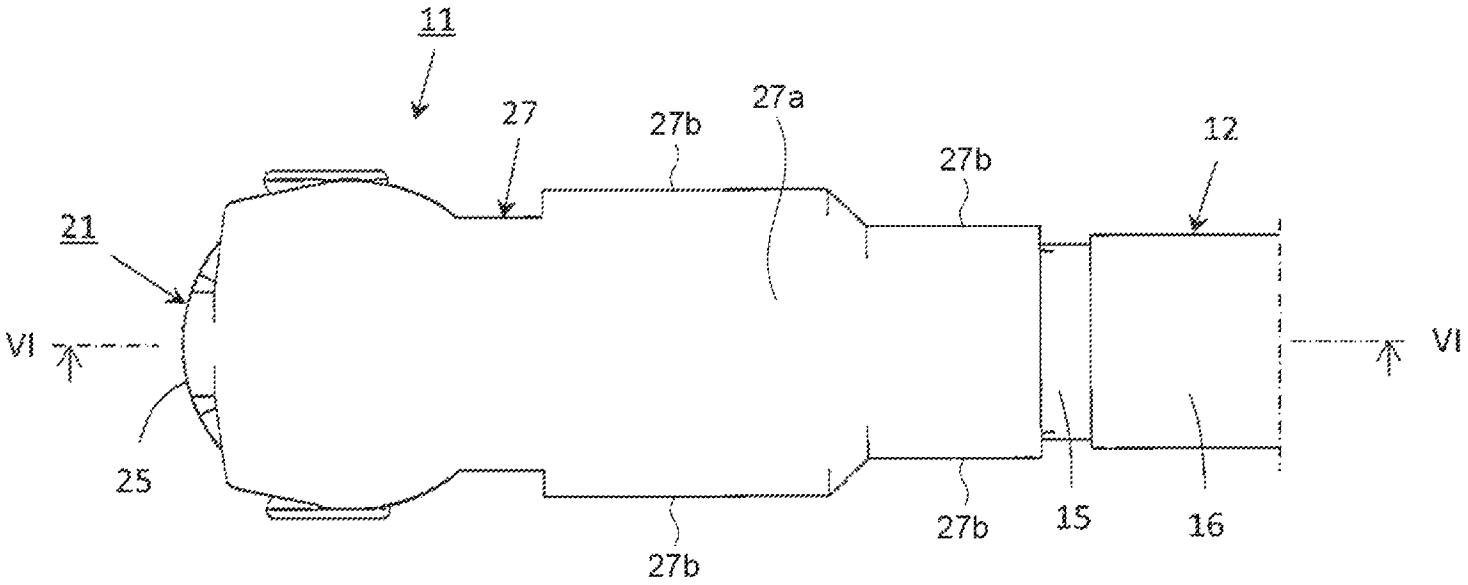
FIG. 5 is a plan view illustrating a state in which an example coaxial connector device according to the present disclosure is mounted on the one end of the coaxial cable.
Figure 6:
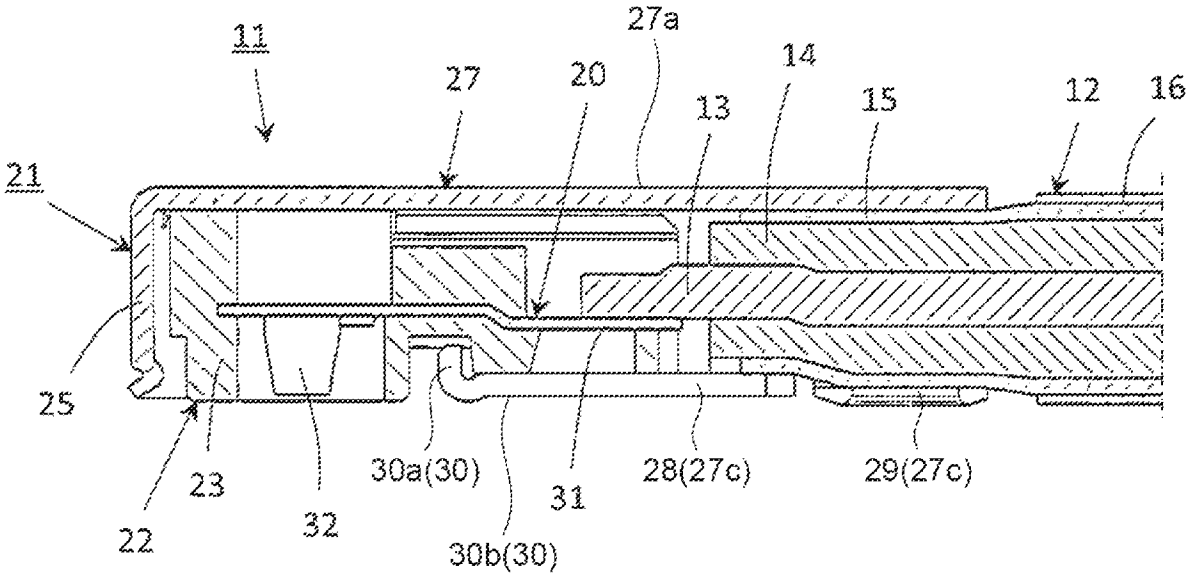
FIG. 6 is a cross-sectional view taken along line VI-VI in FIG. 5.

The ground contact member 21 has a shell portion 27 in addition to the annular fitting portion 25. The shell portion 27 foldably extends from one end of the annular fitting portion 25. The shell portion 27 is folded and connected to the outer conductor 15 of the coaxial cable 12. The center conductor 13 of the coaxial cable 12 is connected to the signal contact member 20. The shell portion 27 of the ground contact member 21 is configured to be selectively positioned in an unfolded upright position relative to the annular fitting portion 25 and in a folded bent position relative to the annular fitting portion 25. In FIG. 1, the shell portion 27 of the ground contact member 21 is disposed at the upright position, and in FIGS. 3 to 5 described later, the shell portion 27 of the ground contact member 21 is disposed at the bent position. Hereinafter, the case where the shell portion 27 is in the bent position will be described. The shell portion 27 is located outside the annular fitting portion 25 (outside a virtual circle along the outer periphery of the annular fitting portion 25). The shell portion 27 accommodates at least a part of the end of the insulating housing member 22 (the end of the center conductor support 24) and the end of the coaxial cable 12. The opening OP1 (the opening between the pair of ends 25*a*) of the annular fitting portion 25 couples the interior of the annular fitting portion 25 with the interior of the shell portion 27. The shell portion 27 has a base plate 27*a* extending outside the annular fitting portion 25 and a pair of side plates 27*b* standing up from the base plate 27*a*. A pair of clamping portions 27*c* is provided at the end of the pair of side plates 27*b*. The pair of clamping portions 27*c* is folded to hold the end of the insulating housing member 22 and the end of the coaxial cable 12 in the shell portion 27. For example, a clamping portion 27*c* holds the end of the insulating housing member 22 and the end of the coaxial cable 12 in cooperation with the base plate 27*a*. In detail, the clamping portion 27*c* has an end of the insulating housing member 22 and an end of the coaxial cable 12 interposed between the clamping portion 27*c* and the base plate 27*a*. Each the clamping portion 27*c* has a first clamping portion 28 and a second clamping portion 29 arranged in order in a direction away from the annular fitting portion 25. A clamping portion 28 clamps the center conductor support 24 and the outer conductor 15 exposed at the end of the coaxial cable 12. In particular, as illustrated in FIG. 6, a clamping portion 29 clamps the outer conductor 15 exposed at the end of the coaxial cable 12. Thus, the ground contact member 21 is connected to the outer conductor 15.

Figure 4:
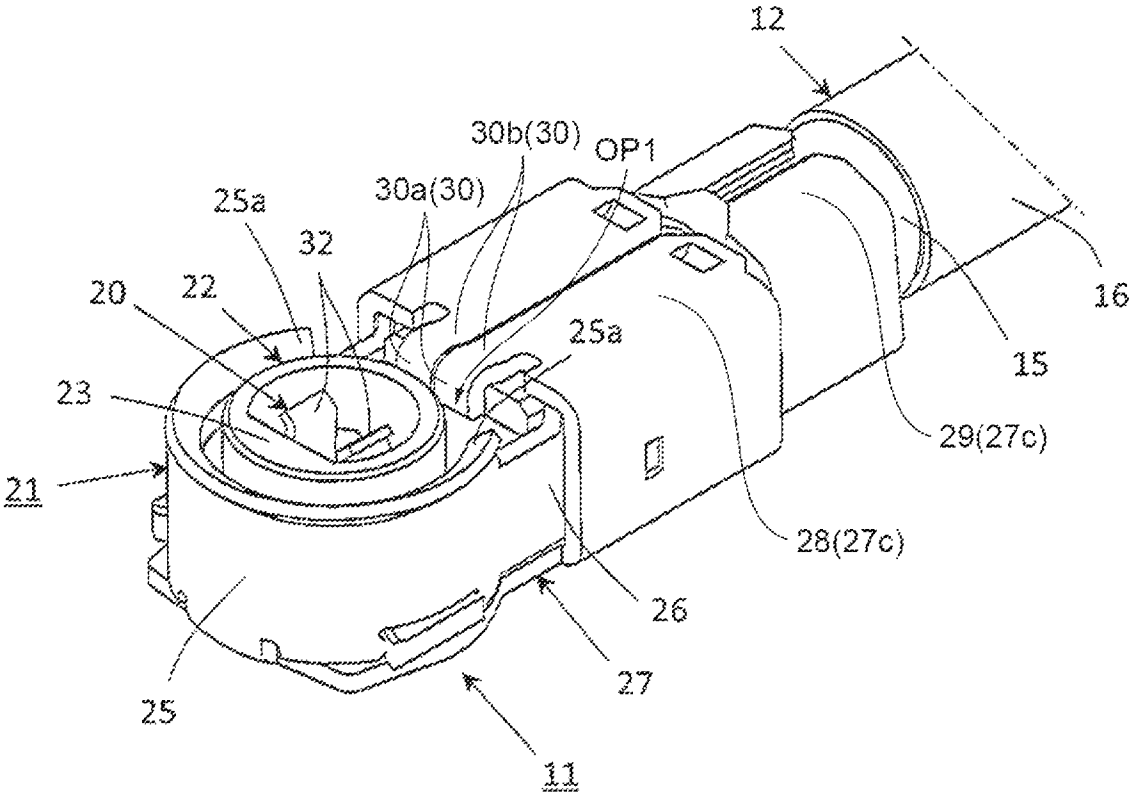
FIG. 4 is a perspective view illustrating a state in which an example coaxial connector device according to the present invention is mounted on the one end of the coaxial cable, as viewed from below.

A pair of first clamping portions 28 provided in the shell portion 27 of the ground contact member 21 is provided with a pair of conductive members 30 bent and extended from one end of each. The pair of conductive members 30 is formed integrally with the first clamping portion 28. As illustrated in FIG. 4, which will be described later, in a state in which each of the pair of first clamping portions 28 is bent to clamp the coaxial cable 12, the pair of conductive members 30 are disposed so as to be close to each other.

The signal contact member 20 in the coaxial connector device 11 has a center conductor connection portion 31 and a contact connection portion 32 (contact portion) as illustrated in FIG. 6 described later. The contact connection portion 32 appears in FIG. 4 described later. The center conductor connection portion 31 is supported by the center conductor support 24 of the insulating housing member 22 and connected to the center conductor 13 of the coaxial cable 12. The contact connection portion 32 extends from the center conductor connection portion 31, is disposed in the cylindrical portion 23 of the insulating housing member 22, and is contacted and connected to the signal contact portion of the mate connector device. The center conductor connection portion 31 extends from the center conductor support 24 of the insulating housing member 22 through the opening OP1 into the cylindrical portion 23. The opening OP1 is formed between the pair of ends 25*a* in the annular fitting portion 25 of the ground contact member 21. The cylindrical portion 23 of the insulating housing member 22 is partially surrounded by the annular fitting portion 25 of the ground contact member 21. The opening OP1 is formed for arranging the center conductor connection portion 31 of the signal contact member 20 to which the center conductor 13 of the coaxial cable 12 is connected.

Figure 2:
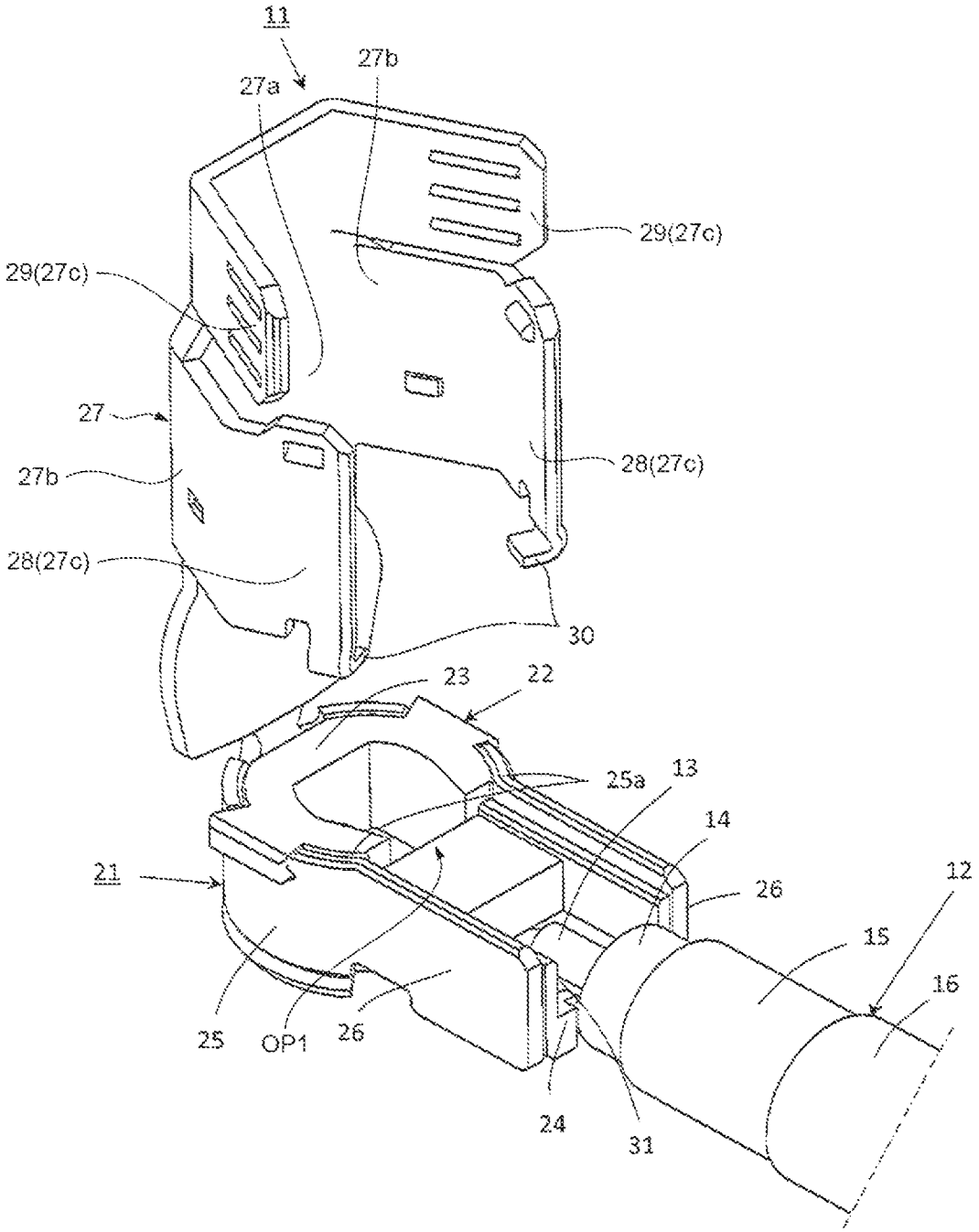
FIG. 2 is a perspective view illustrating a process in which an example coaxial connector device according to the present disclosure is mounted on one end of a coaxial cable.

When the coaxial connector device 11 as described above is attached to one end of the coaxial cable 12, first, as illustrated in FIG. 2, at one end of the coaxial cable 12, the surface insulator 16 is partially excised to expose the outer conductor 15. Each of the outer conductor 15 and the internal insulator 14 is partially excised to expose the center conductor 13. The center conductor 13 of the coaxial cable 12 with one end is placed on the center conductor connection portion 31 of the signal contact member 20 with the shell portion 27 of the ground contact member 21 in an upright position. The center conductor connection portion 31 of the signal contact member 20 is supported by the center conductor support 24 of the insulating housing member 22. The center conductor 13 of the coaxial cable 12 is connected and secured to the center conductor connection portion 31 of the signal contact member 20 by, for example, ultrasonic welding or soldering.

Thereafter, the shell portion 27 of the ground contact member 21 disposed in the upright position is bent with respect to the annular fitting portion 25 of the ground contact member 21 and disposed in the bent position. As a result, the shell portion 27 is brought into contact with the outer conductor 15 of the coaxial cable 12. The center conductor 13 of the coaxial cable 12 is connected to the center conductor connection portion 31 of the signal contact member 20.

Figure 3:
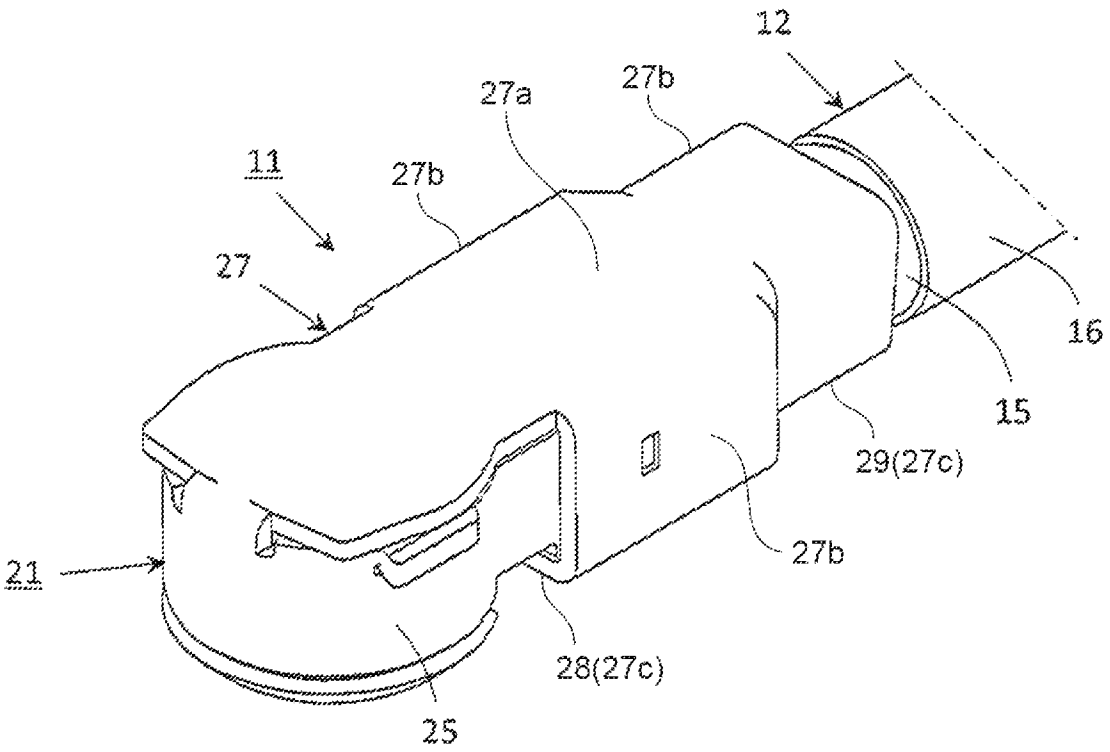
FIG. 3 is a perspective view illustrating a state in which an example coaxial connector device according to the present disclosure is mounted on the one end of the coaxial cable, as viewed from above.

Thereafter, each of the pair of first clamping portions 28 is bent at the shell portion 27 disposed in the bending position. Each of the pair of first clamping portions 28 is fastened to the pair of arm portions 26 so as to wrap the pair of arm portions 26 from the outside thereof, and is fastened to the outer conductor 15 of the coaxial cable 12. The pair of arm portions 26 each extend from the pair of ends 25*a* in the annular fitting portion 25 of the ground contact member 21. The center conductor 13 of the coaxial cable 12 is connected to the center conductor connection portion 31 of the signal contact member 20. Each of a pair of second clamping portions 29 is folded to clamp the coaxial cable 12 to the outer conductor 15. As a result, the shell portion 27 of the ground contact member 21 is connected and secured to the outer conductor 15 of the coaxial cable 12. As a result, as illustrated in FIGS. 3, 4, 5, and 6, the state in which the coaxial connector device 11 is mounted on one end of the coaxial cable 12 is firmly maintained. FIG. 3 is a perspective view of the coaxial connector device 11 mounted on one end of the coaxial cable 12 as viewed from above, FIG. 4 is a perspective view of the coaxial connector device 11 mounted on one end of the coaxial cable 12 as viewed from below, FIG. 5 is a plan view of the coaxial connector device 11 mounted on one end of the coaxial cable 12, and FIG. 6 is a sectional view taken along line VI-VI in FIG. 5.

At this time, as illustrated in FIG. 4, the pair of conductive members 30 are disposed close to each other to partially fill the opening OP1. The pair of conductive members 30 is bent and extended from one end of each of the pair of first clamping portions 28. The opening OP1 is formed between the pair of ends 25*a* in the annular fitting portion 25 of the ground contact member 21. The cylindrical portion 23 is surrounded by the annular fitting portion 25 of the ground contact member 21 and the pair of conductive members 30. Inside the cylindrical portion 23 of the insulating housing member 22, the contact connection portion 32 of the signal contact member 20 is disposed. Each of the conductive members 30 includes a first conductive portion 30*a* and a second conductive portion 30*b*. The first conductive portion 30*a* fills at least a part of the opening OP1 and surrounds the contact connection portion 32 together with the annular fitting portion 25 (surrounds the cylindrical portion 23). The second conductive portion 30*b* extends from the first conductive portion 30*a* to the outside of the annular fitting portion 25 (in a direction away from the central axis of the annular fitting portion 25) and is connected to the clamping portion 27*c*. The first conductive portion 30*a* and the second conductive portion 30*b* may be integrally formed with the annular fitting portion 25, the shell portion 27, and the clamping portion 28. For example, the first conductive portion 30*a*, the second conductive portion 30*b*, the annular fitting portion 25, the shell portion 27, and the clamping portion 28 may be integrally formed of a metal plate. For example, the first conductive portion 30*a* and the second conductive portion 30*b* are secured to (or extend from) the clamping portion 28. For example, the first conductive portion 30*a* and the second conductive portion 30*b* are integrally formed with the clamping portion 28 by a single plate member. The second conductive portion 30*b* may extend from the clamping portion 28 toward the annular fitting portion 25, and the first conductive portion 30*a* may be bent with respect to the second conductive portion 30*b*.

Figure 7:
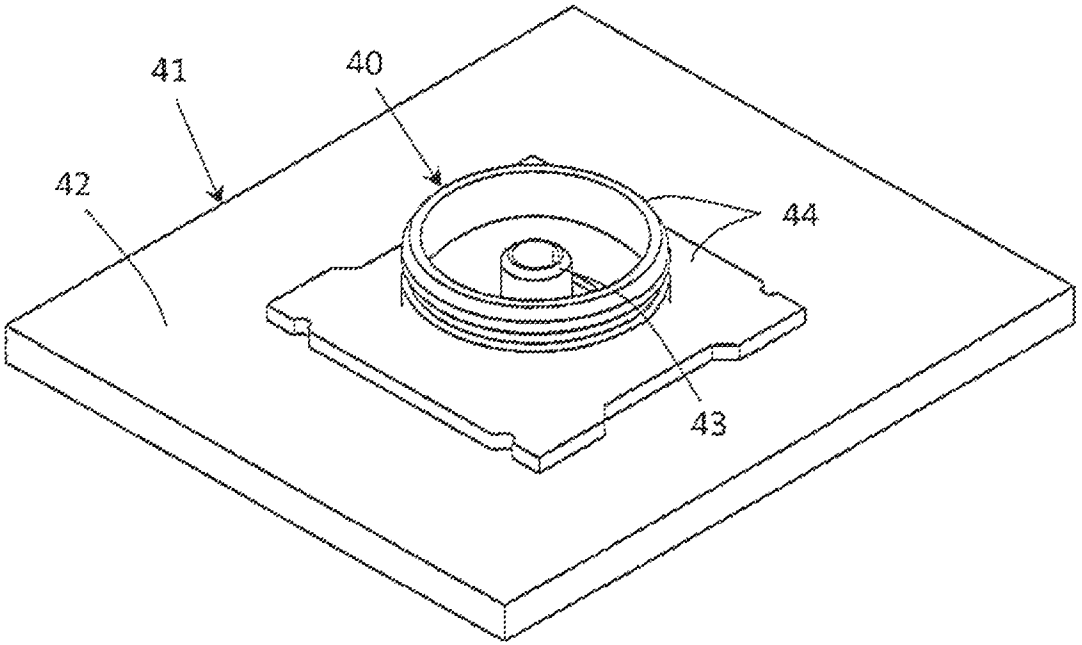
FIG. 7 is a perspective view illustrating an example mate connector device to which an example coaxial connector device according to the present disclosure is connected, together with a circuit board.

FIG. 7 illustrates a mate connector device 40, which is an example mate connector device to which the coaxial connector device 11 is connected, and a circuit board 41 to which the mate connector device 40 is attached. The mate connector device 40 is secured on a component mounting surface 42 in the circuit board 41.

The mate connector device 40 includes a signal contact portion 43 and a ground contact portion 44. The signal contact portion 43 is formed of a conductive material and is erected on the component mounting surface 42 in the circuit board 41. The signal contact portion 43 is electrically connected to a signal terminal (not shown) provided in the component mounting surface 42 of the circuit board 41. The ground contact portion 44 is formed of a conductive material in an annular shape, and the ground contact portion 44 is secured to the circuit board 41 in a state of protruding from the component mounting surface 42 and surrounding the signal contact portion 43. The ground contact portion 44 is electrically connected to a ground potential portion (not illustrated in the drawings) provided on the component mounting surface 42. A coaxial connector 11 is connected to the mate connector device 40. In the ground contact portion 44, the annular fitting portion 25 of the ground contact member 21 included in the coaxial connector device 11 is fitted and connected.

Figure 8:
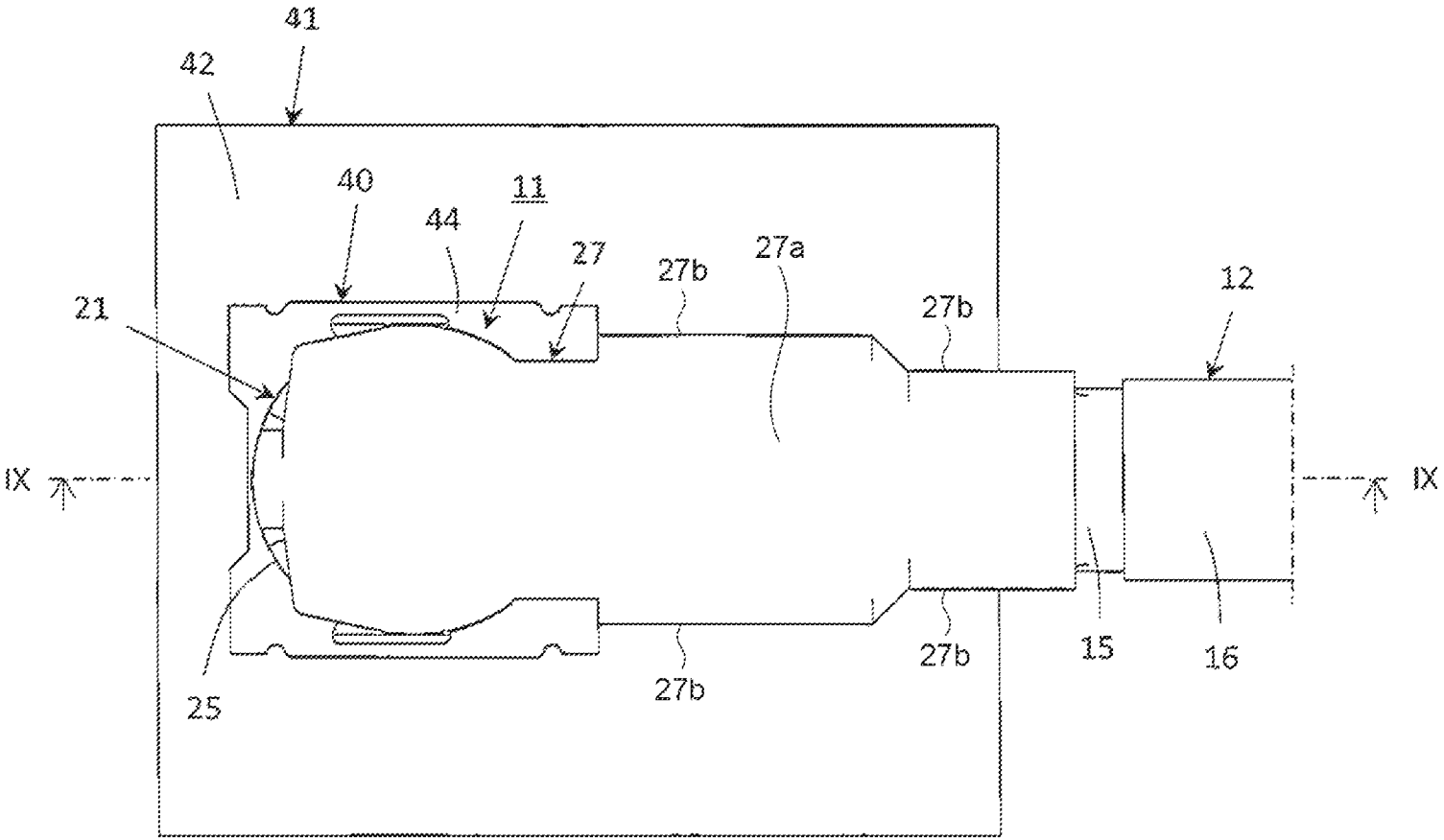
FIG. 8 is a plan view illustrating a state in which an example coaxial connector device according to the present disclosure is mounted on the one end of a coaxial cable, the example mate connector device is mounted on the circuit board, and the example coaxial connector device is mechanically and electrically connected to the example mate connector device.
Figure 9:
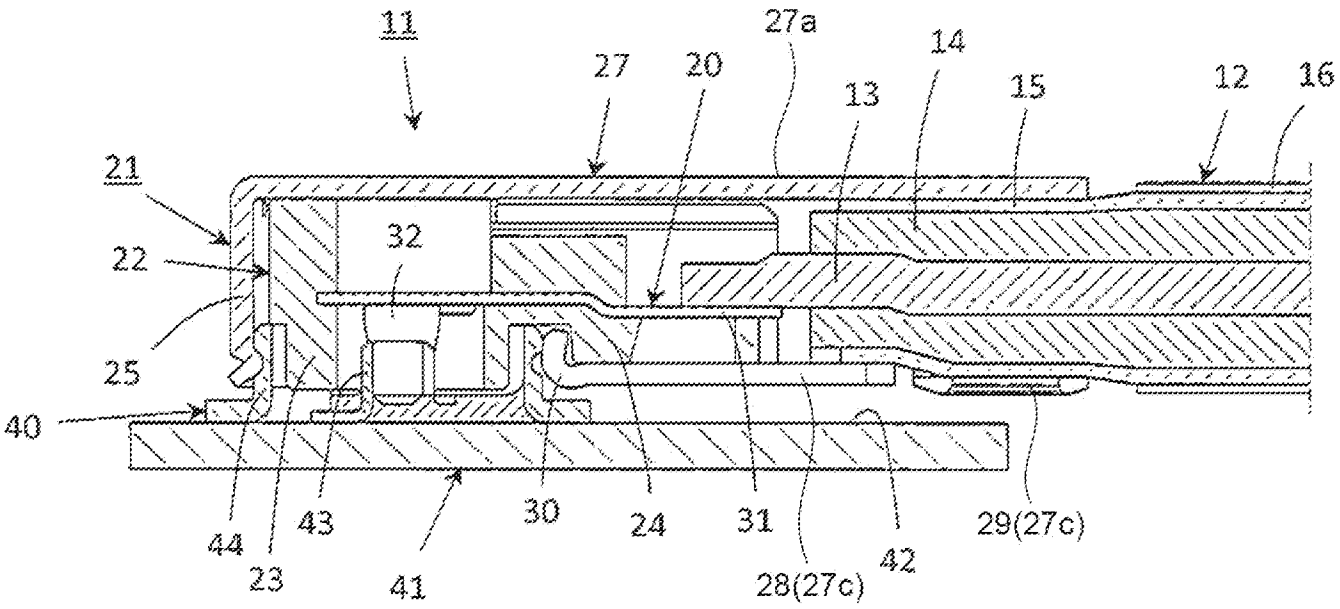
FIG. 9 is a cross-sectional view taken along line IX-IX in FIG. 8.

The coaxial connector device 11 illustrated in FIGS. 3, 4, 5, and 6 is attached to one end of the coaxial cable 12. FIGS. 8 and 9 illustrate a state in which the coaxial connector device 11 illustrated in FIGS. 3, 4, 5, and 6 is connected to the mate connector device 40 illustrated in FIG. 7. As illustrated in FIGS. 8 and 9, when the coaxial connector device 11 is connected to the mate connector device 40, the annular fitting portion 25 of the ground contact member 21 of the coaxial connector device 11 is fitted and connected to the ground contact portion 44 of the mate connector device 40. Further, the conductive member 30 integrally provided in the first clamping portion 28 of the shell portion 27 of the ground contact member 21 of the coaxial connector device 11 is contacted and connected to the ground contact portion 44 of the mate connector device 40.

In this way, the annular fitting portion 25 of the ground contact member 21 of the coaxial connector device 11 attached to one end of the coaxial cable 12 is fitted and connected to the ground contact portion 44 of the mate connector device 40. Further, in a state where the conductive member 30 provided integrally with the first clamping portion 28 of the shell portion 27 of the ground contact member 21 is contacted and connected to the ground contact portion 44 of the mate connector device 40, as illustrated in FIG. 9, the contact connection portion 32 is contacted and connected to the signal contact portion 43 of the mate connector device 40. FIG. 9 illustrates a cross section taken along line IX-IX in FIG. 8. The contact connection portion 32 of the signal contact member 20 is located inside the cylindrical portion 23 of the insulating housing member 22. The signal contact member 20 is supported by the insulating housing member 22 in the coaxial connector device 11. The center conductor connection portion 31 of the signal contact member 20 is connected to the center conductor 13 of the coaxial cable 12. The center conductor 13 of the coaxial cable 12 is connected to the signal terminal of the component mounting surface 42 of the circuit board 41 through the signal contact member 20 of the coaxial connector device 11 and the signal contact portion 43 of the mate connector device 40. The outer conductor 15 of the coaxial cable 12 is connected to the ground potential part of the circuit board 41 through the ground contact member 21 of the coaxial connector device 11 and the ground contact portion 44 of the mate connector device 40.

At this time, the first conductive portions 30*a* of the pair of conductive members 30 are disposed close to each other so as to partially fill the opening OP1. The opening OP1 is formed between the pair of ends 25*a* in the annular fitting portion 25 of the ground contact member 21. The first conductive portion 30*a* contacts the ground contact portion 44 when the annular fitting portion 25 fits the ground contact portion 44. The first conductive portion 30*a* is given ground potential through the pair of first clamping portions 28 and the ground contact portion 44 of the mate connector device 40. The pair of conductive members 30 is bent and extended from one end of each of the pair of first clamping portions 28 in the shell portion 27 of the ground contact member 21 of the coaxial connector device 11, and is provided integrally with the first clamping portion 28. Thereby, the cylindrical portion 23 is surrounded by the annular fitting portion 25 and the pair of conductive members 30 of the ground contact member 21 of the coaxial connector device 11 given the ground potential. As a result, in the coaxial connector device 11, leakage of a radio frequency signal passing through the signal contact member 20 to the outside through the opening OP1 of the annular fitting portion 25 of the ground contact member 21 may be reduced. The contact connection portion 32 of the signal contact member 20 in the coaxial connector device 11 is disposed inside the cylindrical portion 23 of the insulating housing member 22 in the coaxial connector device 11. Further, since at least a part between the annular fitting portion 25 and the clamping portion 27*c* is filled by the second conductive portion 30*b* of the conductive member 30, leakage of the radio frequency signal through between the annular fitting portion 25 and the clamping portion 27*c* may also be reduced.

Figure 10:
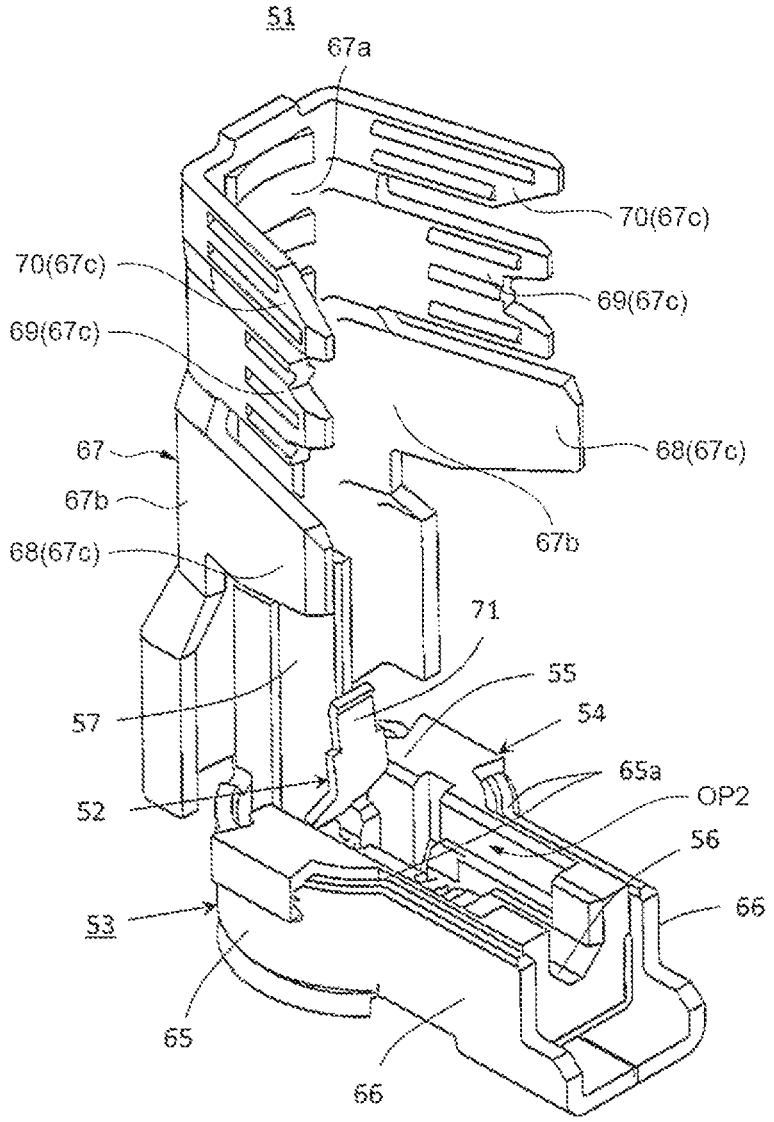
FIG. 10 is a perspective view illustrating an example coaxial connector device according to the present disclosure.

FIG. 10 illustrates a coaxial connector device 51 constituting an example coaxial connector device according to the present disclosure. The coaxial connector device 51 is also attached to one end of the coaxial cable. The coaxial cable to which the coaxial connector device 51 is attached at one end is the same as the coaxial cable 12 illustrated in FIG. 2. As illustrated in FIG. 2, at one end to which the coaxial connector device 51 is attached, the surface insulator 16 is partially excised to expose the outer conductor 15, and each of the outer conductor 15 and the internal insulator 14 is partially excised to expose the center conductor 13.

The coaxial connector device 51 includes a signal contact member 52, a ground contact member 53, and an insulating housing member 54 as main constituent element. The signal contact member 52 is formed of an elastic conductive material and is electrically connected to the center conductor 13 of the coaxial cable 12. The ground contact member 53 is formed of an elastic conductive material and is electrically connected to the outer conductor 15 of the coaxial cable 12. The insulating housing member 54 is formed of an insulating material such as a plastic material and supports the signal contact member 52 and the ground contact member 53 in a mutually insulated state. The ground contact member 53 includes a conductive member 58 described later. The conductive member 58 is formed separately from the body of the ground contact member 53.

Figure 11:
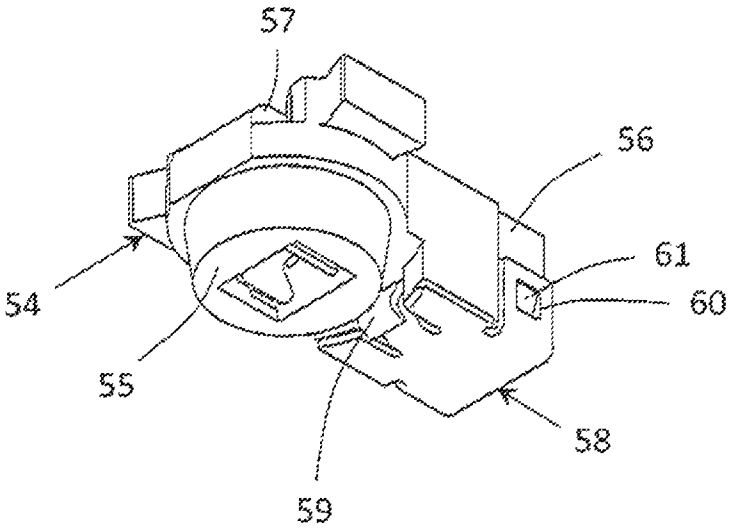
FIG. 11 is a perspective view illustrating an insulating housing and a conductive member included in an example coaxial connector device according to the present disclosure.

As illustrated in FIG. 11, the insulating housing member 54 includes a cylindrical portion 55 and a center conductor support 56. The cylindrical portion 55 holds the signal contact member 52. The center conductor support 56 extends from the cylindrical portion 55 and supports the center conductor 13 of the coaxial cable 12. The center conductor 13 of the coaxial cable 12 is connected to the signal contact member 52. A bent contact portion 57 which is foldable extends from one end of the cylindrical portion 55. The bent contact portion 57 is folded and pressed against the signal contact member 52.

Figure 12:
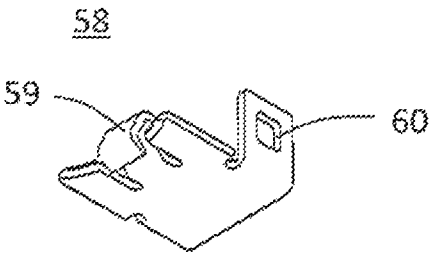
FIG. 12 is a perspective view of a conductive member included in an example coaxial connector device according to the present disclosure as viewed from below.
Figure 13:
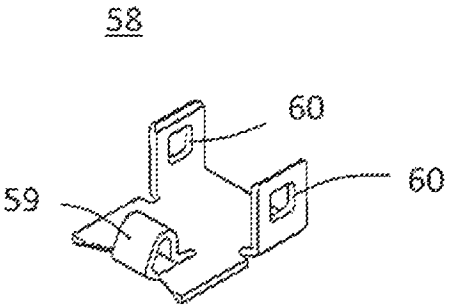
FIG. 13 is a perspective view of the conductive member included in an example coaxial connector device according to the present disclosure as viewed from above.

As illustrated in FIG. 11, in the insulating housing member 54, the conductive member 58 formed of an elastic conductive material is attached to an outer surface portion of the center conductor support 56. As illustrated in FIGS. 12 and 13, the conductive member 58 is formed, for example, by punching and bending a metallic plate. The conductive member 58 has an elastic contact portion 59 at one end thereof. A pair of engagement through-holes 60 is formed in the conductive member 58, and a protruding engagement portion 61 is provided on the outer surface of the center conductor support 56 in the insulating housing member 54. Each of these engagement through-holes 60 is engaged with the protruding engagement portion 61 and the conductive member 58 is secured to the outer surface of the center conductor support 56 of the insulating housing member 54.

The ground contact member 53 in the coaxial connector device 51 has an annular fitting portion 65. The annular fitting portion 65 partially surrounds the cylindrical portion 55 of the insulating housing member 54. In the annular fitting portion 65, an opening OP2 sandwiched by a pair of ends 65*a* facing each other is formed. The opening OP2 is sandwiched by the pair of ends 65*a* of the annular fitting portion 65 that face each other. From the pair of ends 65*a*, a pair of arm portions 66 extends along the center conductor support 56 of the insulating housing member 54. The pair of arm portions 66 face each other across the center conductor support 56. The cylindrical portion 55 of the insulating housing member 54 and the annular fitting portion 65 of the ground contact member 53 partially surrounding the cylindrical portion 55 constitute a fitting connection portion in the coaxial connector device 51. The coaxial connector device 51 mounted at one end of the coaxial cable 12 is fittingly connected to the mate connector device by the fitting connection portion. At this time, the annular fitting portion 65 is fitted and connected to the ground contact portion of the mate connector device.

The ground contact member 53 has a shell portion 67 in addition to the annular fitting portion 65. The shell portion 67 foldably extends from one end of the annular fitting portion 65. The shell portion 67 is folded and connected to the outer conductor 15 of the coaxial cable 12. The center conductor 13 of the coaxial cable 12 is connected to the signal contact member 52. The shell portion 67 of the ground contact member 53 is configured to be selectively positioned in an unfolded upright position relative to the annular fitting portion 65 and in a folded bent position relative to the annular fitting portion 65. In FIG. 10, the shell portion 67 of the ground contact member 53 is disposed at the upright position, and in FIGS. 15 to 17 described later, the shell portion 67 of the ground contact member 53 is disposed at the bent position. Hereinafter, the case where the shell portion 67 is in the bent position will be described. The shell portion 67 is located outside the annular fitting portion 65 (outside a virtual circle along the outer periphery of the annular fitting portion 65). The shell portion 67 accommodates the end of the insulating housing member 54 (the center conductor support 56) and the end of the coaxial cable 12. The opening OP2 (the opening between the pair of ends 65*a*) of the annular fitting portion 65 couples the interior of the annular fitting portion 65 with the interior of the shell portion 67. The shell portion 67 has a base plate 67*a* extending outside the annular fitting portion 65 and a pair of side plates 67*b* standing up from the base plate 67*a*. A pair of clamping portions 67*c* is provided at the end of the pair of side plates 67*b*. The pair of clamping portions 67*c* is folded to hold the end of the insulating housing member 54 and the end of the coaxial cable 12 in the shell portion 67. For example, a clamping portion 67*c* holds the end of the insulating housing member 54 and the end of the coaxial cable 12 in cooperation with the base plate 67*a*. In detail, the clamping portion 67*c* has an end of the insulating housing member 54 and an end of the coaxial cable 12 interposed between the clamping portion 67*c* and the base plate 67*a*. Each the clamping portion 67*c* has a first bent engaging portion 68, a second bent engagement portion 69, and a third bent engagement portion 70 arranged in order in a direction away from the annular fitting portion 65. The bent engagement portion 68 engages the conductive member 58 secured to the outer surface of the center conductor support 56 of the insulating housing member 54. Thus, the conductive member 58 is connected to the clamping portion 67*c*. As illustrated particularly in FIG. 18, the bent engagement portion 69 engages the outer conductor 15 exposed at the end of the coaxial cable 12. Thus, the ground contact member 53 is connected to the outer conductor 15. The bent engagement portion 70 engages the surface insulator 16 at the end of the coaxial cable 12.

The signal contact member 52 in the coaxial connector device 51 includes a center conductor connection portion 71 and a contact connection portion 72 (contact portion). The contact connection portion 72 appears in FIG. 16. The center conductor connection portion 71 can be bent in a substantially L-shape, and when it is bent, it is brought into contact with and connected to the center conductor 13 of the coaxial cable 12. The contact connection portion 72 extends from the portion of the signal contact member 52 where the center conductor connection portion 71 is provided. The contact connection portion 72 is disposed in the cylindrical portion 55 of the insulating housing member 54. The cylindrical portion 55 of the insulating housing member 54 is partially surrounded by the annular fitting portion 65 of the ground contact member 53.

Figure 14:
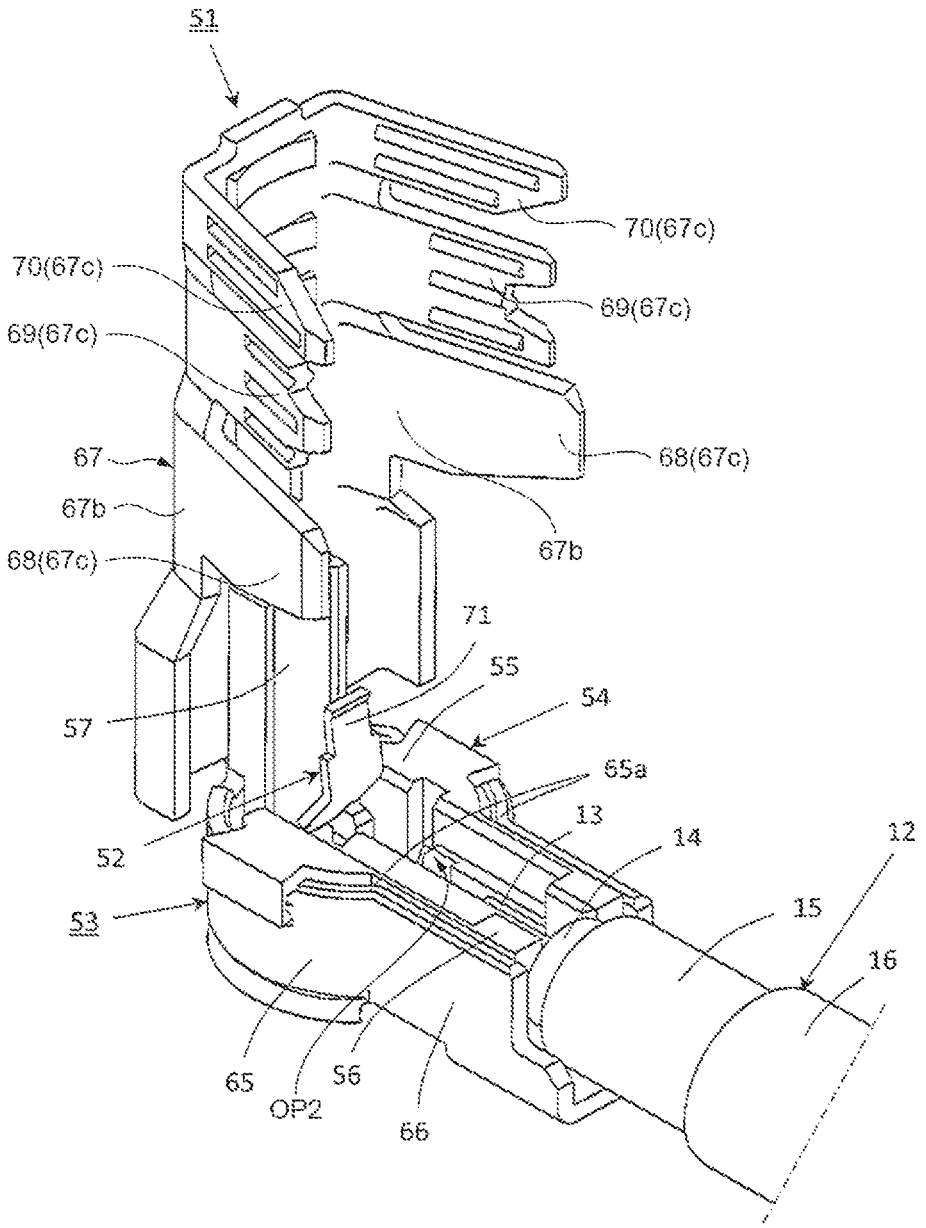
FIG. 14 is a perspective view illustrating a process in which an example coaxial connector device according to the present disclosure is mounted on one end of a coaxial cable.

When the coaxial connector device 51 as described above is attached to one end of the coaxial cable 12, first, as illustrated in FIG. 14, at one end of the coaxial cable 12, the surface insulator 16 is partially excised to expose the outer conductor 15. Each of the outer conductor 15 and the internal insulator 14 is partially excised to expose the center conductor 13. The center conductor 13 of the coaxial cable 12 with one end is placed on the center conductor support 56 of the insulating housing member 54 with the shell portion 67 of the ground contact member 53 in an upright position.

Thereafter, the shell portion 67 of the ground contact member 53 disposed in the upright position is bent with respect to the annular fitting portion 65 of the ground contact member 53 and disposed in the bent position. The center conductor 13 of the coaxial cable 12 is placed on the center conductor support 56 in the insulating housing member 54. The bent contact portion 57 of the insulating housing member 54 is folded along with the shell portion 67, abuts against the center conductor connection portion 71 of the signal contact member 52, moves the center conductor connection portion 71 so as to push it toward the center conductor 13 of the coaxial cable 12, and presses the center conductor connection portion 71 against the center conductor 13 of the coaxial cable 12. Thus, the center conductor 13 of the coaxial cable 12 is mechanically and electrically connected to the center conductor connection portion 71 of the signal contact member 52. At this time, the center conductor 13 of the coaxial cable 12 connected to the center conductor connection portion 71 of the signal contact member 52 extends from the center conductor support 56 of the insulating housing member 54 into the cylindrical portion 55 of the insulating housing member 54 through the opening OP2. The opening OP2 is formed between the pair of ends 65*a* in the annular fitting portion 65 of the ground contact member 53. The cylindrical portion 55 of the insulating housing member 54 is partially surrounded by the annular fitting portion 65 of the ground contact member 53. The center conductor 13 of the coaxial cable 12 connected to the center conductor connection portion 71 of the signal contact member 52 is disposed in the opening OP2 formed between the pair of ends 65*a* in the annular fitting portion 65 of the ground contact member 53.

Figure 15:
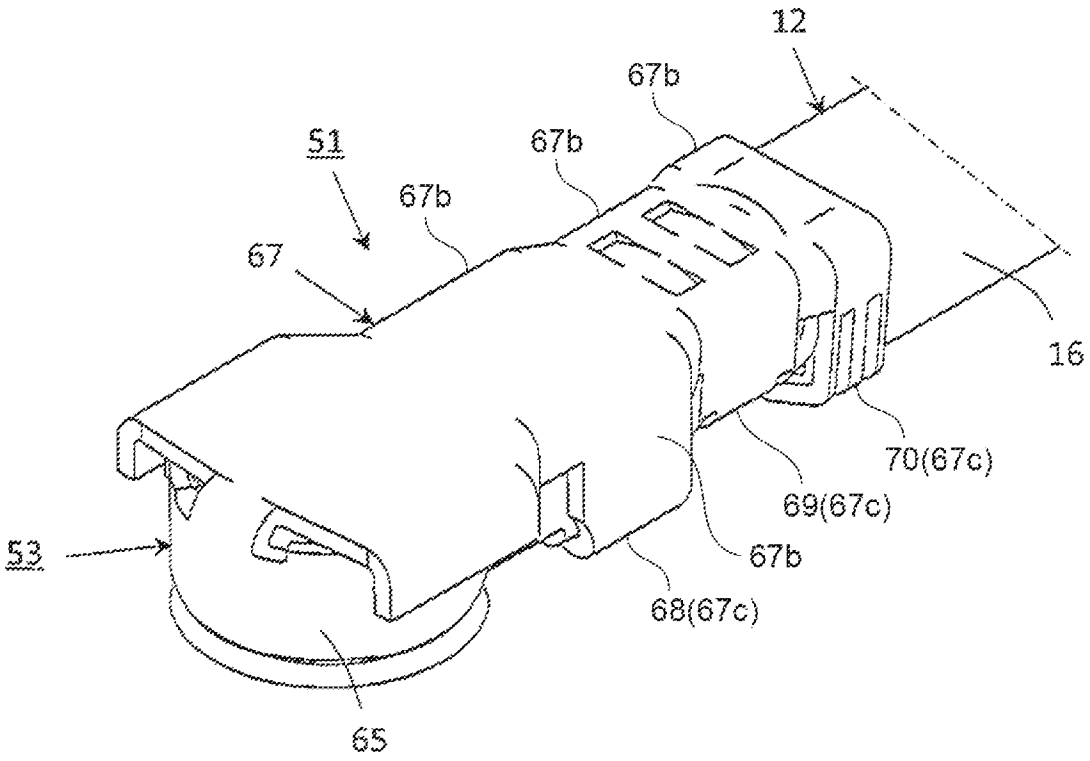
FIG. 15 is a perspective view illustrating a state in which an example coaxial connector device according to the present disclosure is mounted on the one end of the coaxial cable, as viewed from above.
Figure 16:
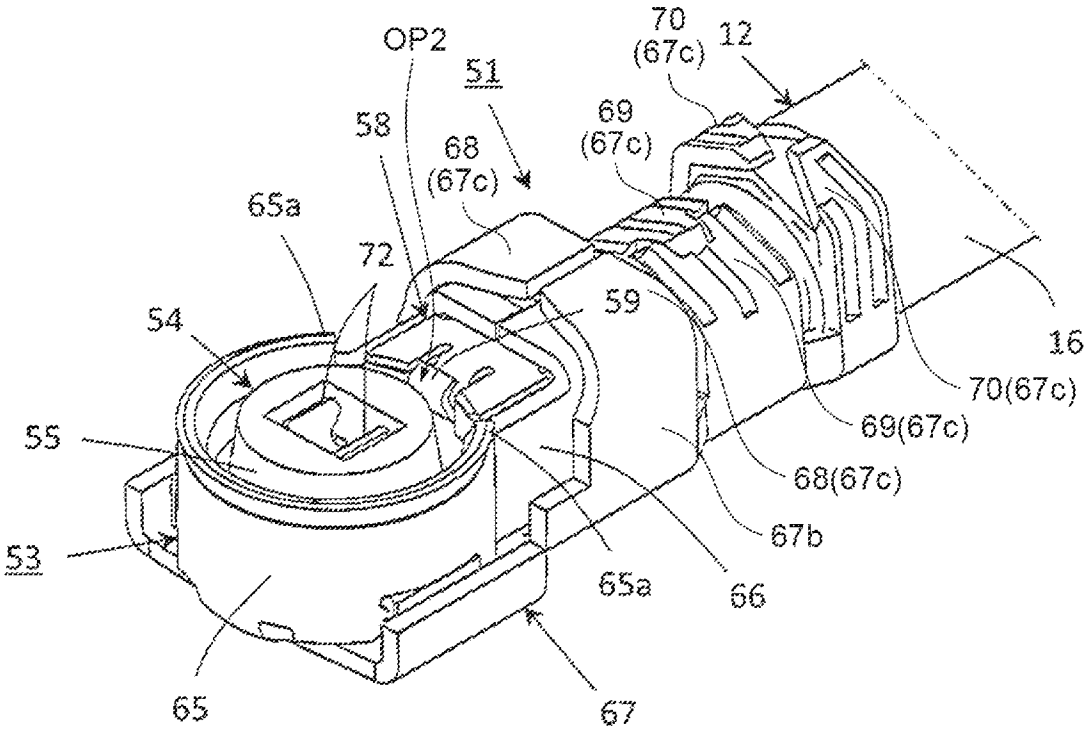
FIG. 16 is a perspective view illustrating a state in which an example coaxial connector device according to the present disclosure is mounted on the one end of the coaxial cable, as viewed from below.
Figure 17:
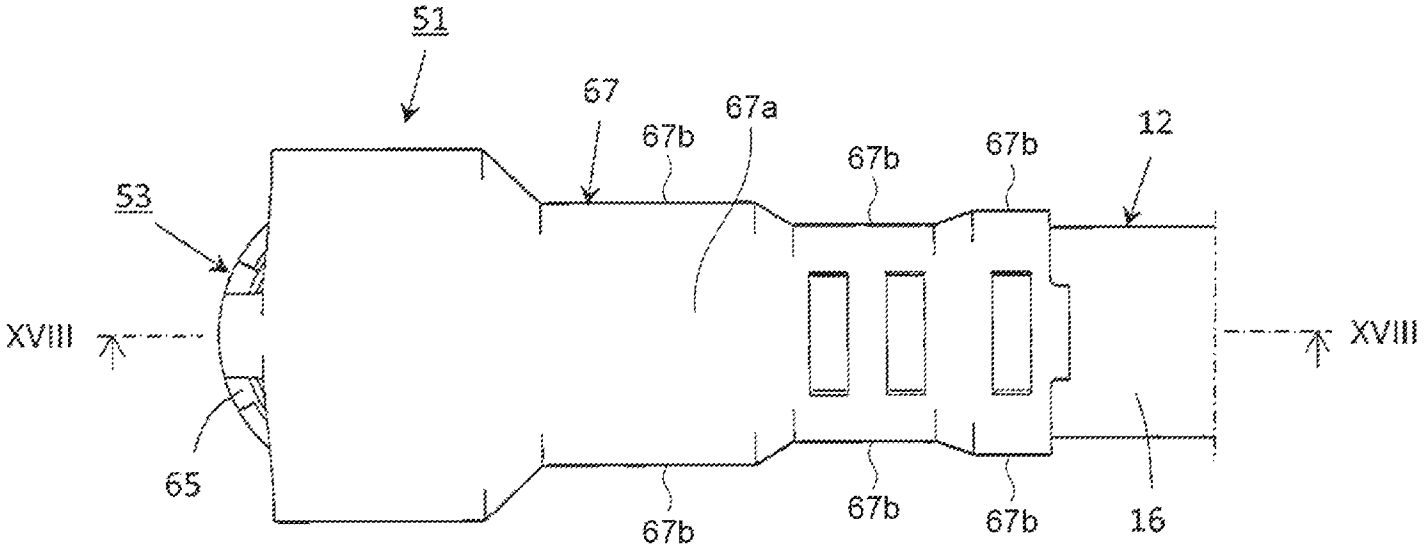
FIG. 17 is a plan view illustrating a state in which an example coaxial connector device according to the present disclosure is mounted on the one end of the coaxial cable.
Figure 18:
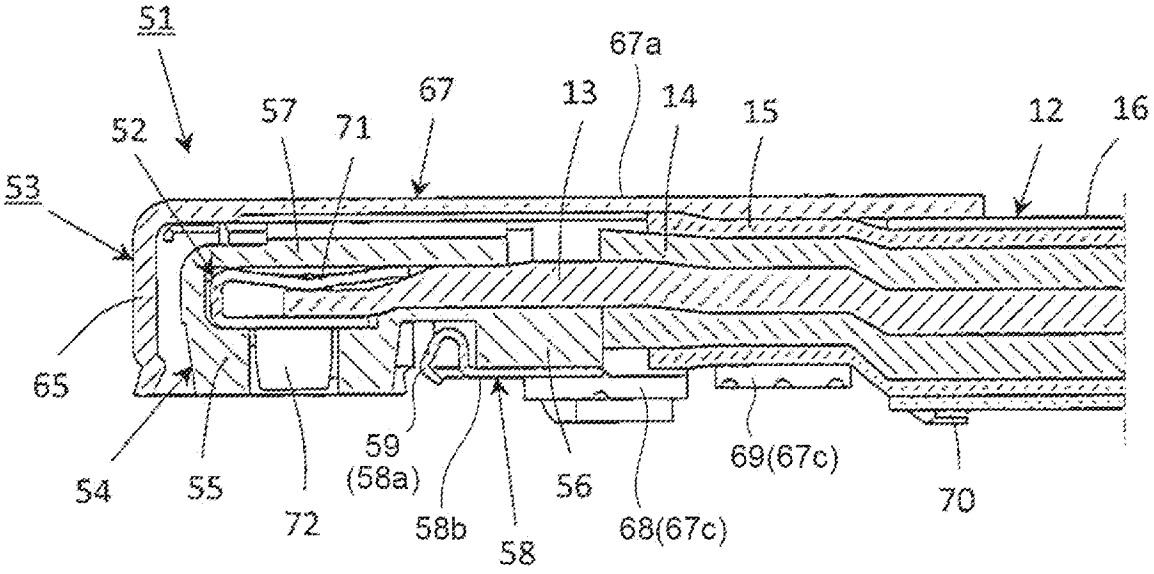
FIG. 18 is a cross-sectional view taken along line XVIII-XVIII in FIG. 17.

The conductive member 58 is secured to an outer surface portion of the center conductor support 56 in the insulating housing member 54. In the shell portion 67 disposed in the bent position, each of a pair of first bent engaging portions 68 is folded to engage the conductive member 58. Each of a pair of second bent engagement portions 69 is folded to engage the outer conductor 15 of the coaxial cable 12. The center conductor 13 of the coaxial cable 12 is connected to the center conductor connection portion 71 of the signal contact member 52. Further, each of a pair of third bent engagement portions 70 is folded to engage the surface insulator 16 of the coaxial cable 12. Thus, the shell portion 67 of the ground contact member 53 is connected to the outer conductor 15 of the coaxial cable 12. As a result, as illustrated in FIGS. 15, 16, 17, and 18, the state in which the coaxial connector device 51 is mounted on one end of the coaxial cable 12 is firmly maintained. FIG. 15 is a perspective view of the coaxial connector device 51 mounted on one end of the coaxial cable 12 as viewed from above, FIG. 16 is a perspective view of the coaxial connector device 51 mounted on one end of the coaxial cable 12 as viewed from below, FIG. 17 is a plan view of the coaxial connector device 51 mounted on one end of the coaxial cable 12, and FIG. 18 is a sectional view taken along line XVIII-XVIII in FIG. 17.

As illustrated in FIG. 18, the conductive member 58 is secured to the outer surface of the center conductor support 56 in the insulating housing member 54. In the ground contact member 53, the opening OP2 is formed between the pair of ends 65*a* in the annular fitting portion 65. The conductive member 58 is disposed at a position where the opening OP2 is partially filled by the portion forming the elastic contact portion 59. Thus, the cylindrical portion 55 of the insulating housing member 54 is surrounded by the annular fitting portion 65 and the conductive member 58 of the ground contact member 53. Inside the cylindrical portion 55 of the insulating housing member 54, the contact connection portion 72 of the signal contact member 52 is disposed. Thus, the conductive member 58 includes a first conductive portion 58*a* (the elastic contact portion 59) and a second conductive portion 58*b*. The first conductive portion 58*a* (the elastic contact portion 59) fills at least a part of the opening OP2 and surrounds the contact connection portion 72 (surrounds the cylindrical portion 55) together with the annular fitting portion 65. The second conductive portion 58*b* extends from the first conductive portion 58*a* to the outside of the annular fitting portion 65 (in a direction away from the central axis of the annular fitting portion 65) and is connected to the clamping portion 67*c*. The first conductive portion 58*a* and the second conductive portion 58*b* are formed separately from the annular fitting portion 65, the shell portion 67, and the clamping portion 67*c*. The first conductive portion 58*a* is integrally formed with the second conductive portion 58*b*. The first conductive portion 58*a* is bent with respect to the second conductive portion 58*b* to form the elastic contact portion 59. The first conductive portion 58*a* and the second conductive portion 58*b* are secured to the insulating housing member 54 as described above, and the second conductive portion 58*b* contacts the bent engagement portion 68 of the clamping portion 67*c*.

Figure 19:
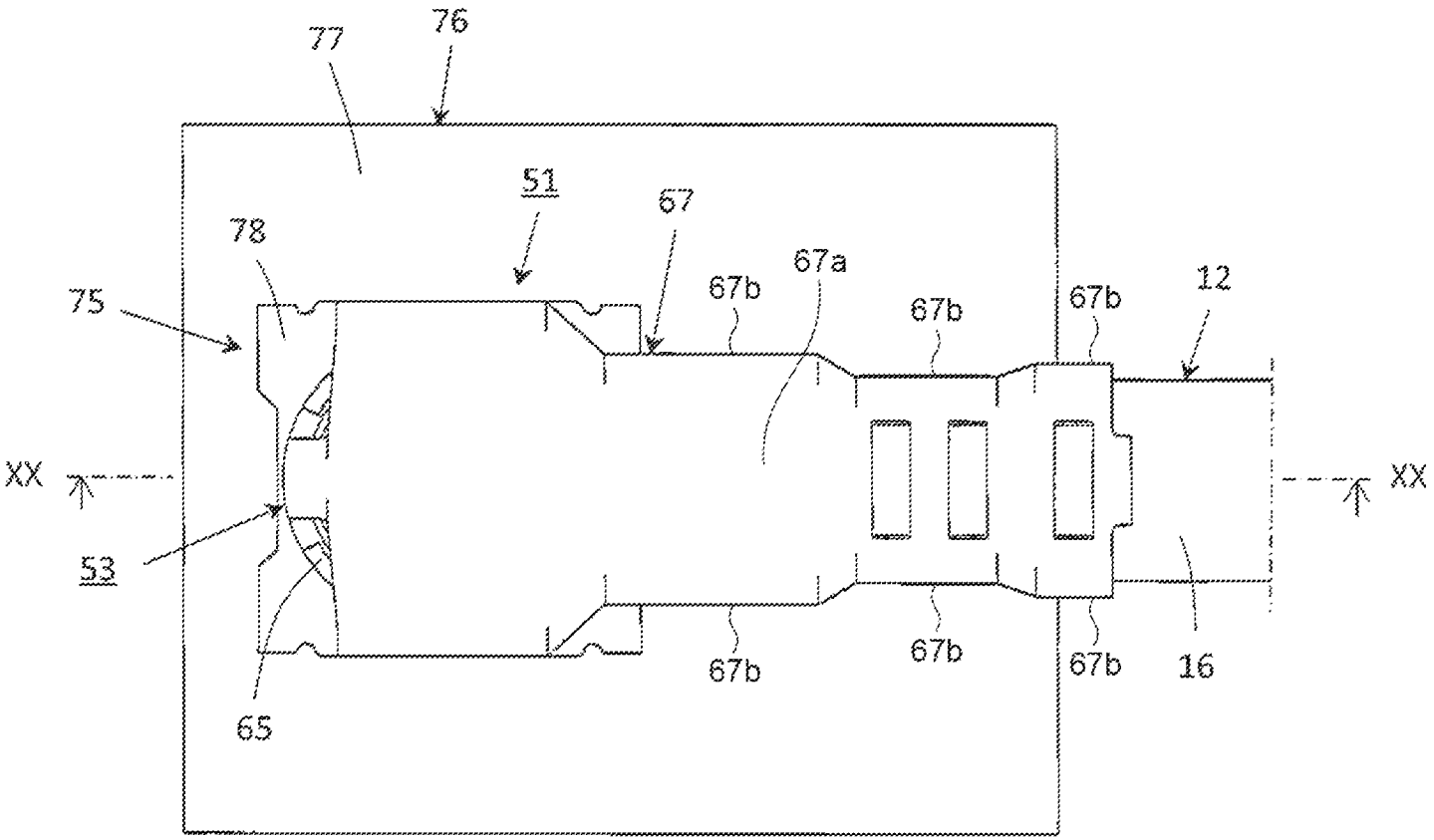
FIG. 19 is a plan view illustrating a state in which an example coaxial connector device according to the present disclosure is mounted on the one end of the coaxial cable, an example mate connector device is mounted on a circuit board, and the example coaxial connector device is connected to the example mate connector device.
Figure 20:
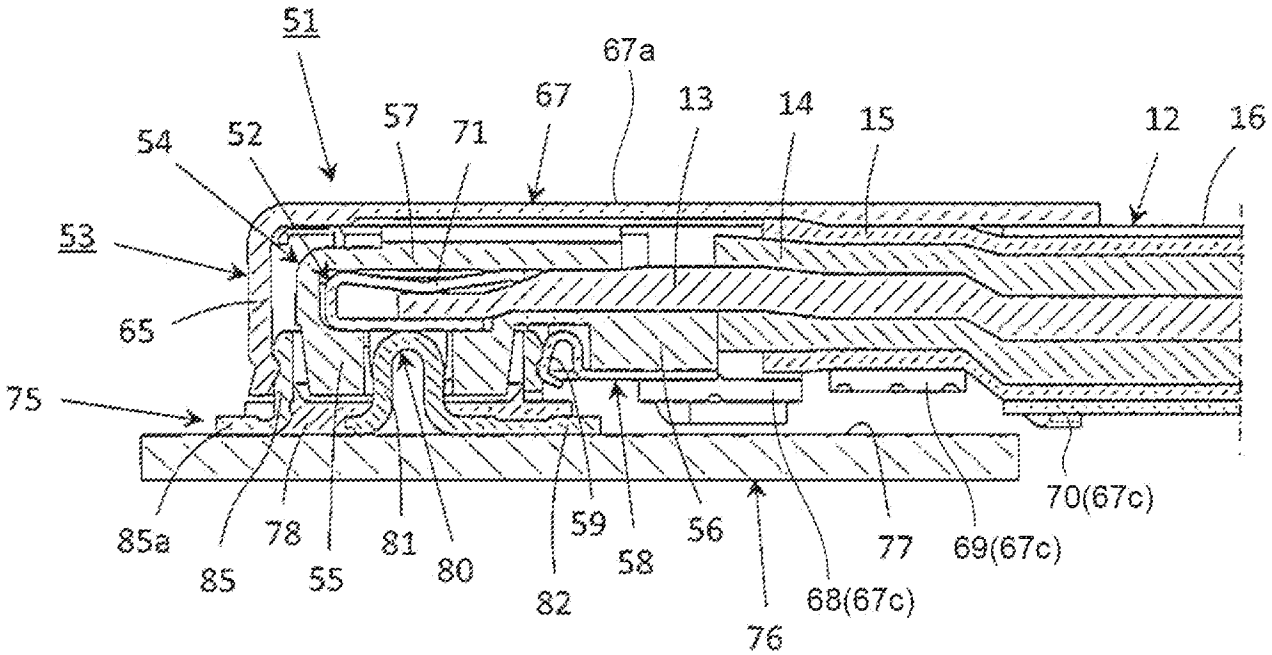
FIG. 20 is a cross-sectional view taken along line XX-XX in FIG. 19.

The coaxial connector device 51 illustrated in FIGS. 15, 16, 17, and 18 is attached to one end of the coaxial cable 12. FIGS. 19 and 20 illustrate a state in which the coaxial connector device 51 illustrated in FIGS. 15, 16, 17, and 18 is connected to a mate connector device 75.

FIG. 20 illustrates a cross section taken along line XX-XX in FIG. 19. As illustrated in FIG. 20, the mate connector device 75 is secured on a component mounting surface 77 in a circuit board 76, and includes an insulating base body 78. The insulating base body 78 is formed of an insulating material such as a synthetic resin material. The insulating base body 78 is placed on the component mounting surface 77 of the circuit board 76 to which the mate connector device 75 is secured. The mate connector device 75 includes a signal contact portion 80. The signal contact portion 80 is formed of a conductive material and assembled to the insulating base body 78. The signal contact portion 80 includes a contact connection portion 81 and a signal connection portion 82. The contact connection portion 81 has a cylindrical portion penetrating the insulating base body 78 through a through hole formed in the insulating base body 78. The signal connection portion 82 extends from the contact connection portion 81 to the exterior of the insulating base body 78. The coaxial connector device 51 is connected to the mate connector device 75. The contact connection portion 81 is contacted and connected to the contact connection portion 72 of the signal contact member 52 of the coaxial connector device 51. A signal terminal (not shown) is provided in the component mounting surface 77 of the circuit board 76 in which the insulating base body 78 is disposed. The signal connection portion 82 is connected to the signal terminal by, for example, soldering.

Further, the mate connector device 75 includes a ground contact portion 85. The ground contact portion 85 is formed of a conductive material so as to form an annular body. The ground contact portion 85 projects outwardly from the insulating base body 78. The ground contact portion 85 is assembled in a state of surrounding the contact connection portion 81 in the signal contact portion 80. The ground contact portion 85 is provided with a ground connection portion 85*a*. The ground connection portion 85*a* extends from the ground contact portion 85 to the exterior of the insulating base body 78. A ground potential portion (not shown) is provided in the component mounting surface 77 of the circuit board 76 in which the insulating base body 78 is disposed. The ground connection portion 85*a* is connected to the ground potential portion, for example, by soldering. The coaxial connector device 51 connected to the mate connector device 75 includes the ground contact member 53. The annular fitting portion 65 of the ground contact member 53 is fitted and connected to the ground contact portion 85.

As illustrated in FIGS. 19 and 20, the coaxial connector device 51 mounted at one end of the coaxial cable 12 is connected to the mate connector device 75. The annular fitting portion 65 of the ground contact member 53 of the coaxial connector device 51 is fit and connected to the ground contact portion 85 of the mate connector device 75. The conductive member 58 is secured to an outer surface portion of the center conductor support 56 of the insulating housing member 54 included in the coaxial connector device 51. The conductive member 58 has the elastic contact portion 59 at one end thereof. The conductive member 58 is contacted and connected to the ground contact portion 85 of the mate connector device 75 by abutting the elastic contact portion 59 against the ground contact portion 85 of the mate connector device 75. Accordingly, the conductive member 58 is connected to the ground potential portion provided in the component mounting surface 77 of the circuit board 76.

In this way, the coaxial connector device 51 is attached to one end of the coaxial cable 12. The annular fitting portion 65 of the ground contact member 53 of the coaxial connector device 51 is fit and connected to the ground contact portion 85 of the mate connector device 75. The conductive member 58 is secured to an outer surface part of the center conductor support 56 of the insulating housing member 54 included in the coaxial connector device 51. The conductive member 58 is contacted and connected to the ground contact portion 85 of the mate connector device 75. As illustrated in FIG. 20, the signal contact member 52 is supported by the insulating housing member 54 of the coaxial connector device 51. The center conductor connection portion 71 of the signal contact member 52 is connected to the center conductor 13 of the coaxial cable 12. The contact connection portion 72 of the signal contact member 52 is disposed inside the cylindrical portion 55 of the insulating housing member 54, and is contacted and connected to the contact connection portion 81 of the signal contact portion 80 of the mate connector device 75. Accordingly, the center conductor 13 of the coaxial cable 12 is connected to the signal terminal of the component mounting surface 77 of the circuit board 76 through the signal contact member 52 of the coaxial connector device 51 and the signal contact portion 80 of the mate connector device 75. In addition, the outer conductor 15 of the coaxial cable 12 is connected to the ground potential part of the circuit board 76 through the ground contact member 53 of the coaxial connector device 51 and the ground contact portion 85 of the mate connector device 75.

At this time, the conductive member 58 is secured to an outer surface portion of the center conductor support 56 in the insulating housing member 54 included in the coaxial connector device 51. The conductive member 58 is given ground potential through the pair of first bent engaging portions 68 and the ground contact portion 85 of the mate connector device 75. In the ground contact member 53, the opening OP2 is formed between the pair of ends 65*a* in the annular fitting portion 65. The conductive member 58 is positioned to partially block the opening OP2 by the portion forming the elastic contact portion 59 (the first conductive portion 58*a*). Inside the cylindrical portion 55 of the insulating housing member 54 of the coaxial connector device 51, the contact connection portion 72 of the signal contact member 52 of the coaxial connector device 51 is disposed. The cylindrical portion 55 will be surrounded by the annular fitting portion 65 and the conductive member 58 of the ground contact member 53 of the coaxial connector device 51 given the ground potential. As a result, in the coaxial connector device 51, leakage of the radio frequency signal passing through the signal contact member 52 to the outside through the opening OP2 provided in the annular fitting portion 65 of the ground contact member 53 may be reduced. In addition, since at least a part of a portion between the annular fitting portion 65 and the clamping portion 67*c* is filled by the second conductive portion 58*b* of the conductive member 58, leakage of the radio frequency signal between the annular fitting portion 65 and the clamping portion 67*c* may be reduced.

Figure 21:
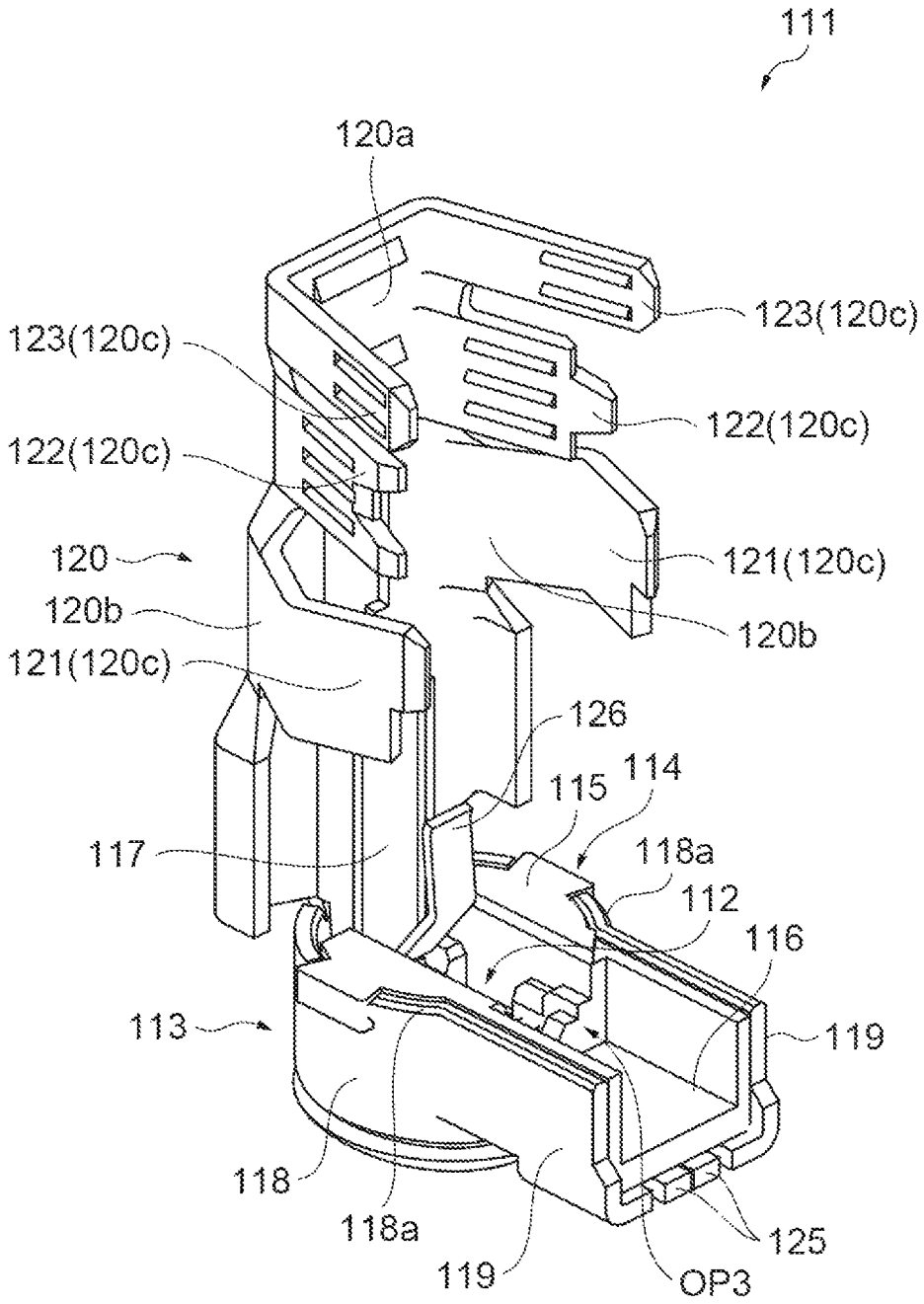
FIG. 21 is a perspective view illustrating an example coaxial connector device according to the present disclosure.

FIG. 21 illustrates a coaxial connector device 111 constituting an example coaxial connector device according to the present disclosure. The coaxial connector device 111 includes a signal contact member 112, a ground contact member 113, and an insulating housing member 114 as main constituent element. The signal contact member 112 is formed of an elastic conductive material and is electrically connected to the center conductor 13 of the coaxial cable 12. The ground contact member 113 is formed of an elastic conductive material and is electrically connected to the outer conductor 15 of the coaxial cable 12. The insulating housing member 114 is formed of an insulating material such as a synthetic resin material, and supports the signal contact member 112 and the ground contact member 113 in a mutually insulated state.

The insulating housing member 114 is provided with a cylindrical portion 115 and a center conductor support 116. The cylindrical portion 115 holds the signal contact member 112. The center conductor 13 of the coaxial cable 12 is connected to the signal contact member 112. The center conductor support 116 extends from the cylindrical portion 115 and supports the center conductor 13 of the coaxial cable 12 through the signal contact member 112. A bent contact portion 117 which is foldable extends from one end of the cylindrical portion 115. The bent contact portion 117 is pressed against the signal contact member 112 when folded.

The ground contact member 113 has an annular fitting portion 118 that partially surrounds the cylindrical portion 115 of the insulating housing member 114. An opening OP3 is formed in the annular fitting portion 118. The opening OP3 is sandwiched by a pair of ends 118*a* of the annular fitting portion 118 that face each other. From the pair of ends 118*a*, a pair of arm portions 119 extend along the center conductor support 116 of the insulating housing member 114. The pair of arm portions 119 face each other across the center conductor support 116. The cylindrical portion 115 of the insulating housing member 114 and the annular fitting portion 118 of the ground contact member 113 partially surrounding the cylindrical portion 115 constitute a fitting connection portion in the coaxial connector device 111. The coaxial connector device 111 mounted at one end of the coaxial cable 12 is fitted and connected to a mate connector device, which is another connector device, by the fitting connection portion. At this time, the annular fitting portion 118 is fitted and connected to the ground contact portion of the mate connector device.

The ground contact member 113 has a shell portion 120 in addition to the annular fitting portion 118. The shell portion 120 foldably extends from one end of the annular fitting portion 118. The shell portion 120 is folded and connected to the outer conductor 15 of the coaxial cable 12. The center conductor 13 of the coaxial cable 12 is connected to the signal contact member 112. The shell portion 120 of the ground contact member 113 is configured to be selectively positioned in an unfolded upright position relative to the annular fitting portion 118 and in a folded bent position relative to the annular fitting portion 118. In FIG. 21, the shell portion 120 of the ground contact member 113 is disposed at the upright position, and in FIGS. 24 to 30 described later, the shell portion 120 of the ground contact member 113 is disposed at the bent position. Hereinafter, the case where the shell portion 120 is disposed at the bent position will be described. The shell portion 120 is located outside the annular fitting portion 118 (outside a virtual circle along the outer periphery of the annular fitting portion 118). The shell portion 120 accommodates at least a part of the end of the insulating housing member 114 (the end of the center conductor support 116) and the end of the coaxial cable 12. The opening OP3 of the annular fitting portion 118 (the opening OP3 sandwiched by the pair of ends 118*a*) couples the interior of the annular fitting portion 118 with the interior of the shell portion 120. The shell portion 120 has a base plate 120*a* extending outside the annular fitting portion 118 and a pair of side plates 120*b* standing up from the base plate 120*a*. A pair of a clamping portion 120*c* are provided at the ends of the pair of side plates 120*b*. The pair of the clamping portion 120*c* are folded to hold the end of the insulating housing member 114 and the end of the coaxial cable 12 in the shell portion 120. For example, the clamping portion 120*c* holds the end of the insulating housing member 114 and the end of the coaxial cable 12 in cooperation with the base plate 120*a*. In detail, the clamping portion 120*c* has an end of the insulating housing member 114 and an end of the coaxial cable 12 interposed between the clamping portion 120*c* and the base plate 120*a*. Each the clamping portion 120*c* has a first bent engagement portion 121, a second bent engagement portion 122, and a third bent engagement portion 123 arranged in order in a direction away from the annular fitting portion 118. As illustrated particularly in FIGS. 23, 24, and 28, a bent engagement portion 121 engages the end of the insulating housing member 114. A bent engagement portion 122 engages the exposed the outer conductor 15 at the end of the coaxial cable 12. Thus, the ground contact member 113 is connected to the outer conductor 15. A bent engagement portion 123 engages the surface insulator 16 at the end of the coaxial cable 12.

The signal contact member 112 in the coaxial connector device 111 includes a center conductor connection portion 126 and a contact connection portion 127 (contact portion). The contact connection portion 127 appears in FIG. 25. The center conductor connection portion 126 is provided so as to be bendable in a substantially L-shape, and is brought into contact with and connected to the center conductor 13 of the coaxial cable 12 when bent. The contact connection portion 127 extends from the portion of the signal contact member 112 where the center conductor connection portion 126 is provided. The contact connection portion 127 is located in the cylindrical portion 115 of the insulating housing member 114 partially surrounded by the annular fitting portion 118 of the ground contact member 113.

Figure 22:
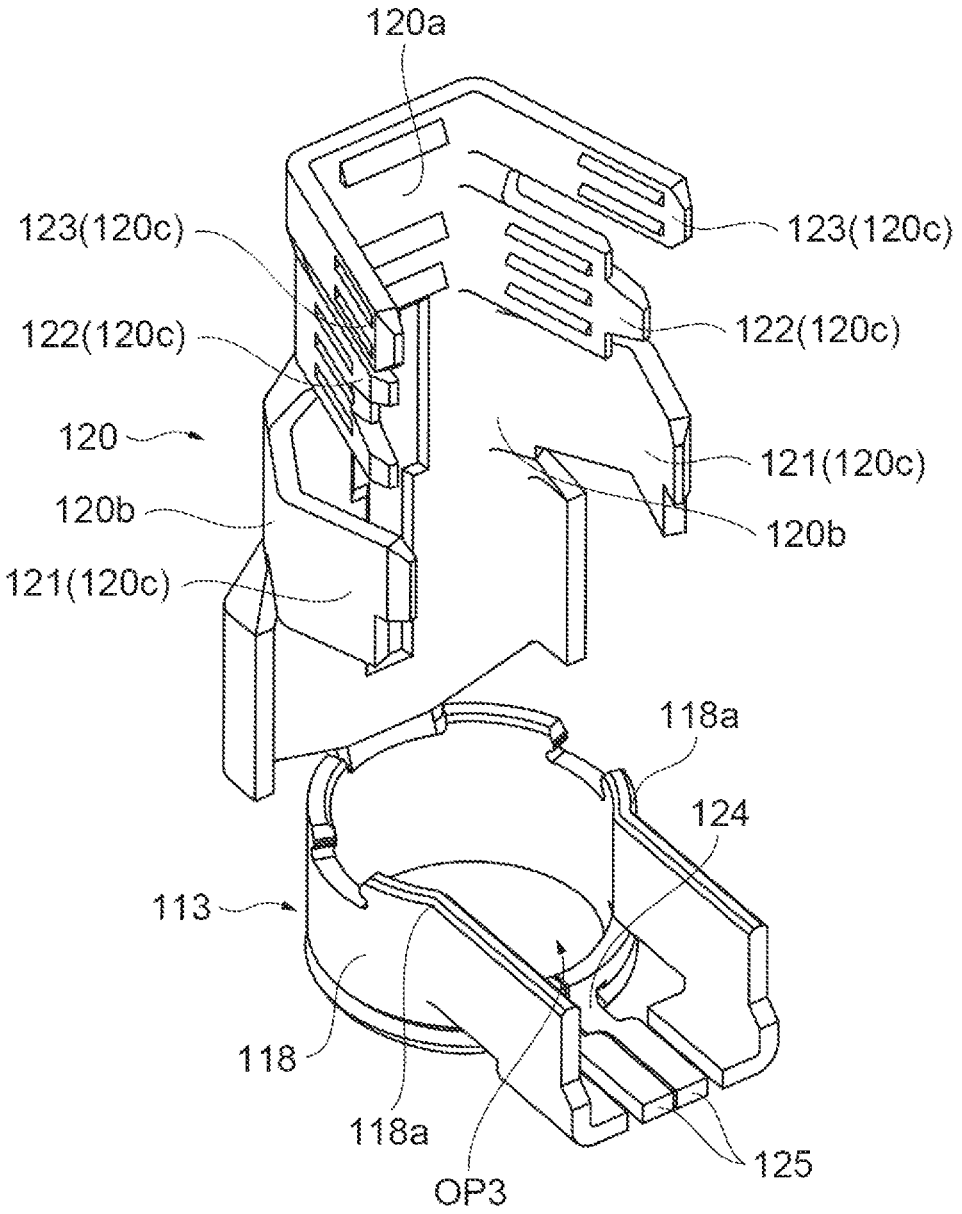
FIG. 22 is a perspective view in which an insulating housing in FIG. 21 is omitted.

As illustrated in FIG. 22, the ground contact member 113 of the coaxial connector device 111 includes a first conductive portion 124 and a second conductive portion 125. The first conductive portion 124 fills at least a part of the opening OP3 and surrounds the contact connection portion 127 together with the annular fitting portion 118 (surrounds the cylindrical portion 115). The second conductive portion 125 extends from the first conductive portion 124 to the outside of the annular fitting portion 118 (in a direction away from the central axis of the annular fitting portion 118) and is connected to the clamping portion 120*c*. The first conductive portion 124 and the second conductive portion 125 may be integrally formed with the annular fitting portion 118, the shell portion 120, and the clamping portion 120*c*. For example, the first conductive portion 124, the second conductive portion 125, the annular fitting portion 118, the shell portion 120, and the clamping portion 120*c* may be integrally formed of a metal plate. The first conductive portion 124 and the second conductive portion 125 are secured to (or extend from) the annular fitting portion 118, and the second conductive portion 125 is in contact with the bent engagement portion 121. For example, the coaxial connector device 111 includes a pair of first conductive portions 124 secured to the pair of ends 118*a* of the annular fitting portion 118 and a pair of second conductive portions 125 connected to the pair of first conductive portions 124. The pair of first conductive portions 124 and the pair of second conductive portions 125 are integrally formed with the annular fitting portion 118 by one plate material. The pair of first conductive portions 124 protrudes from the pair of ends 118*a* along the imaginary circle to the center of the opening OP3. The pair of second conductive portions 125 are connected to the ends of the pair of first conductive portions 124, respectively, and project outward from the annular fitting portion 118. The end of the pair of second conductive portions 125 is clamped by a pair of bent engagement portions 121 together with the center conductor support 116 (see FIGS. 25, 26, and 28). As a result, the second conductive portion 125 contacts the bent engagement portion 121 and is connected to the clamping portion 120*c*.

Figure 23:
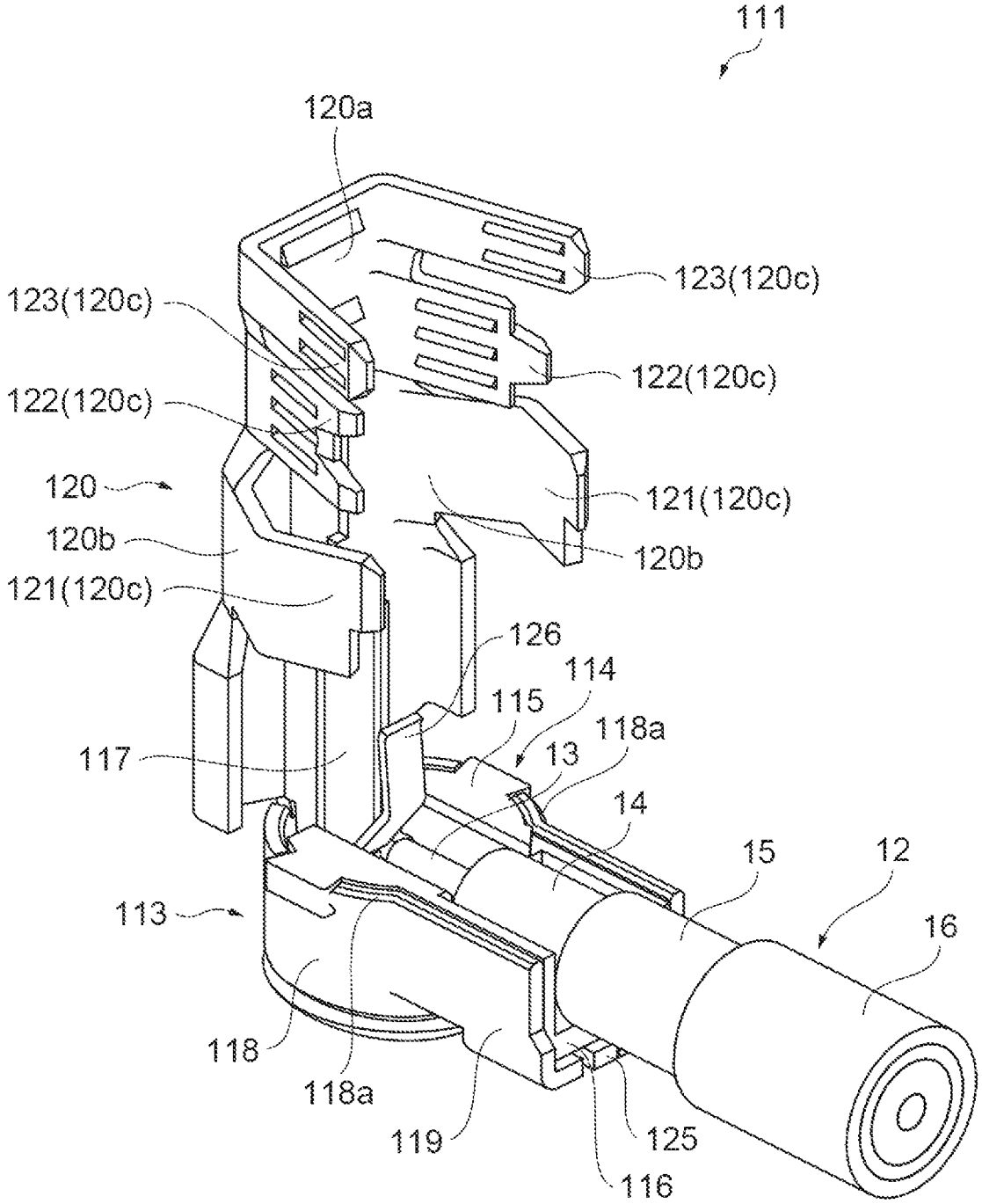
FIG. 23 is a perspective view illustrating a process in which an example coaxial connector device according to the present disclosure is mounted on one end of a coaxial cable.

When the coaxial connector device 111 as described above is attached to one end of the coaxial cable 12, first, as illustrated in FIG. 23, at one end of the coaxial cable 12, the surface insulator 16 is partially excised to expose the outer conductor 15. Each of the outer conductor 15 and the internal insulator 14 is partially excised to expose the center conductor 13. The center conductor 13 of the coaxial cable 12 with one end is placed on the center conductor support 116 of the insulating housing member 114 with the shell portion 120 of the ground contact member 113 in an upright position.

Thereafter, the shell portion 120 of the ground contact member 113 disposed in the upright position is bent with respect to the annular fitting portion 118 of the ground contact member 113 and disposed in the bent position. The center conductor 13 of the coaxial cable 12 is placed on the center conductor support 116 in the insulating housing member 114. The bent contact portion 117 of the insulating housing member 114 is bent with the bending of the shell portion 120, abuts against the center conductor connection portion 126 of the signal contact member 112, moves the center conductor connection portion 126 so as to push it toward the center conductor 13 of the coaxial cable 12, and presses the center conductor connection portion 126 against the center conductor 13 of the coaxial cable 12. Thus, the center conductor 13 of the coaxial cable 12 is mechanically and electrically connected to the center conductor connection portion 126 of the signal contact member 112. At this time, the center conductor 13 of the coaxial cable 12 connected to the center conductor connection portion 126 of the signal contact member 112 extends from the center conductor support 116 of the insulating housing member 114 into the cylindrical portion 115 of the insulating housing member 114 through the opening OP3. The opening OP3 is formed between the pair of ends 118*a* in the annular fitting portion 118 of the ground contact member 113. The center conductor 13 of the coaxial cable 12 connected to the center conductor connection portion 126 of the signal contact member 112 is disposed in the opening OP3 formed between the pair of ends 118*a* in the annular fitting portion 118 of the ground contact member 113.

Figure 24:
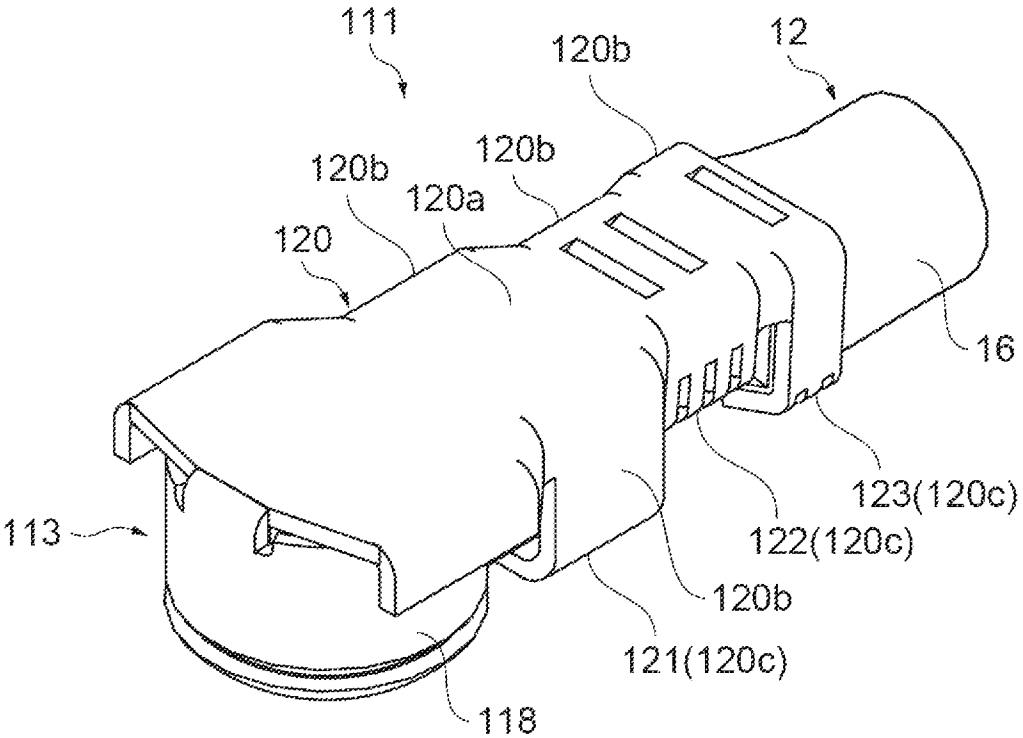
FIG. 24 is a perspective view of an example coaxial connector device according to the present disclosure mounted on the one end of the coaxial cable as viewed from above.
Figure 25:
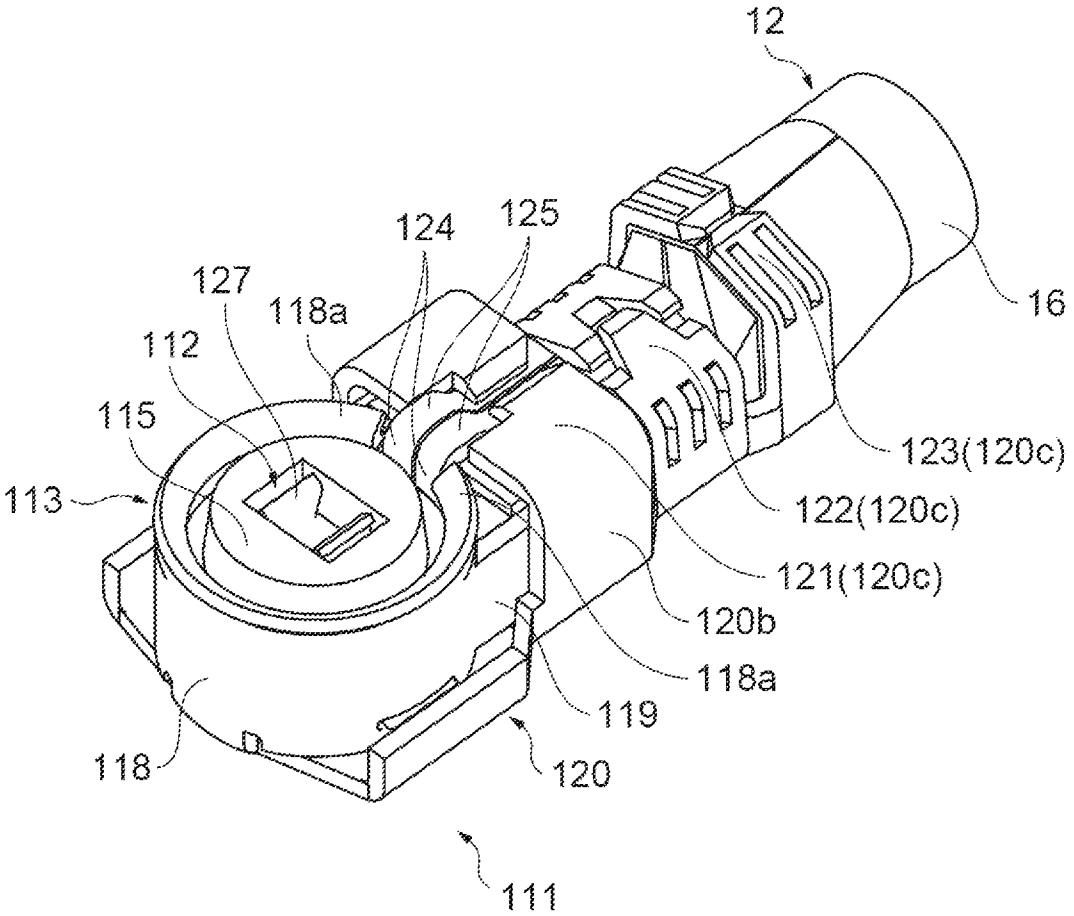
FIG. 25 is a perspective view of an example coaxial connector device according to the present disclosure mounted on the one end of the coaxial cable as viewed from below.
Figure 26:
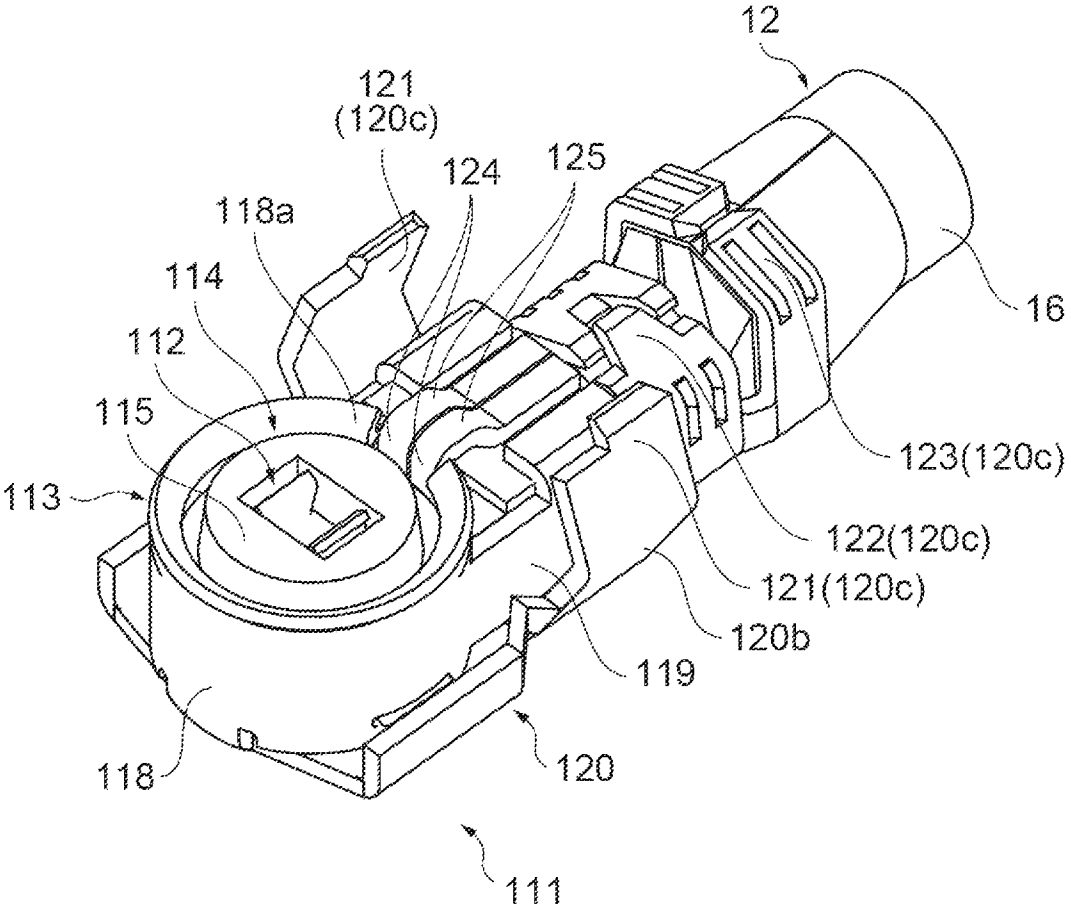
FIG. 26 is a perspective view of a clamping portion of FIG. 25 prior to clamping.
Figure 27:
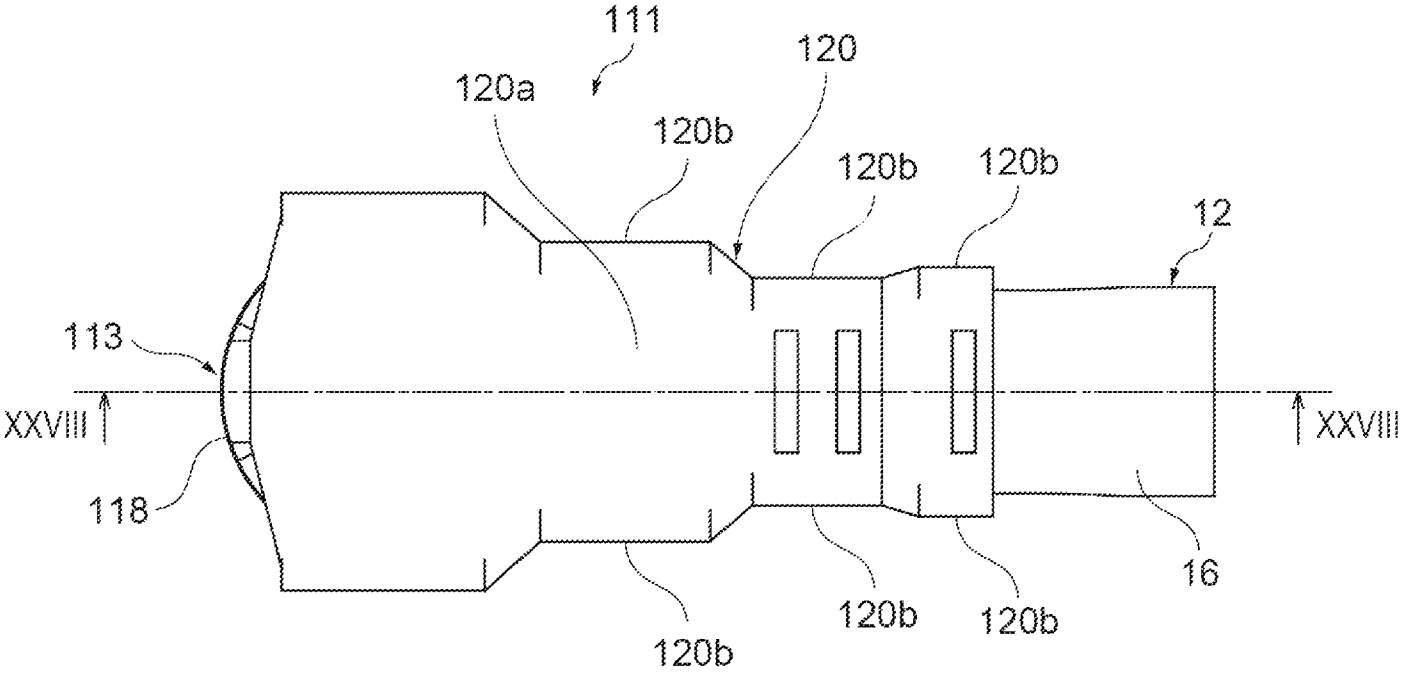
FIG. 27 is a plan view illustrating a state in which an example coaxial connector device according to the present disclosure is mounted on the one end of the coaxial cable.
Figure 28:
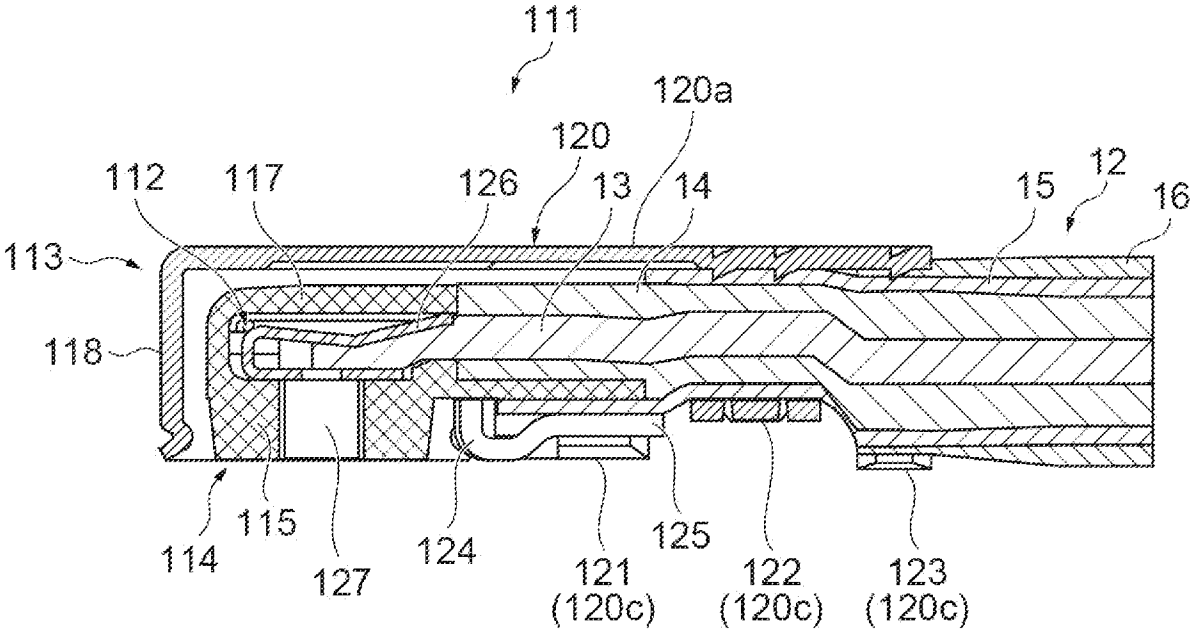
FIG. 28 is a cross-sectional view taken along line XXVIII-XXVIII in FIG. 27.

Further thereafter, in the shell portion 120 disposed in the bent position, each of a pair of first bent engagement portions 121 is bent to engage with the center conductor support 116 of the insulating housing member 114 and to contact with the pair of second conductive portions 125, respectively (see FIGS. 25 and 26). Each of a pair of bent engagement portions 122 is folded and engaged with the outer conductor 15 of the coaxial cable 12. The center conductor 13 of the coaxial cable 12 is connected to the center conductor connection portion 126 of the signal contact member 112. Further, each of a pair of third bent engagement portions 123 is folded to engage the surface insulator 16 of the coaxial cable 12. Thus, the shell portion 120 of the ground contact member 113 is connected to the outer conductor 15 of the coaxial cable 12. As a result, as illustrated in FIGS. 24, 25, 27, and 28, the state in which the coaxial connector device 111 is mounted on one end of the coaxial cable 12 is firmly maintained. FIG. 24 is a perspective view of the coaxial connector device 111 mounted on one end of the coaxial cable 12 as viewed from above, FIG. 25 is a perspective view of the coaxial connector device 111 mounted on one end of the coaxial cable 12 as viewed from below, FIG. 27 is a plan view of the coaxial connector device 111 mounted on one end of the coaxial cable 12, and FIG. 28 is a sectional view taken along line XXVIII-XXVIII in FIG. 27.

Figure 29:
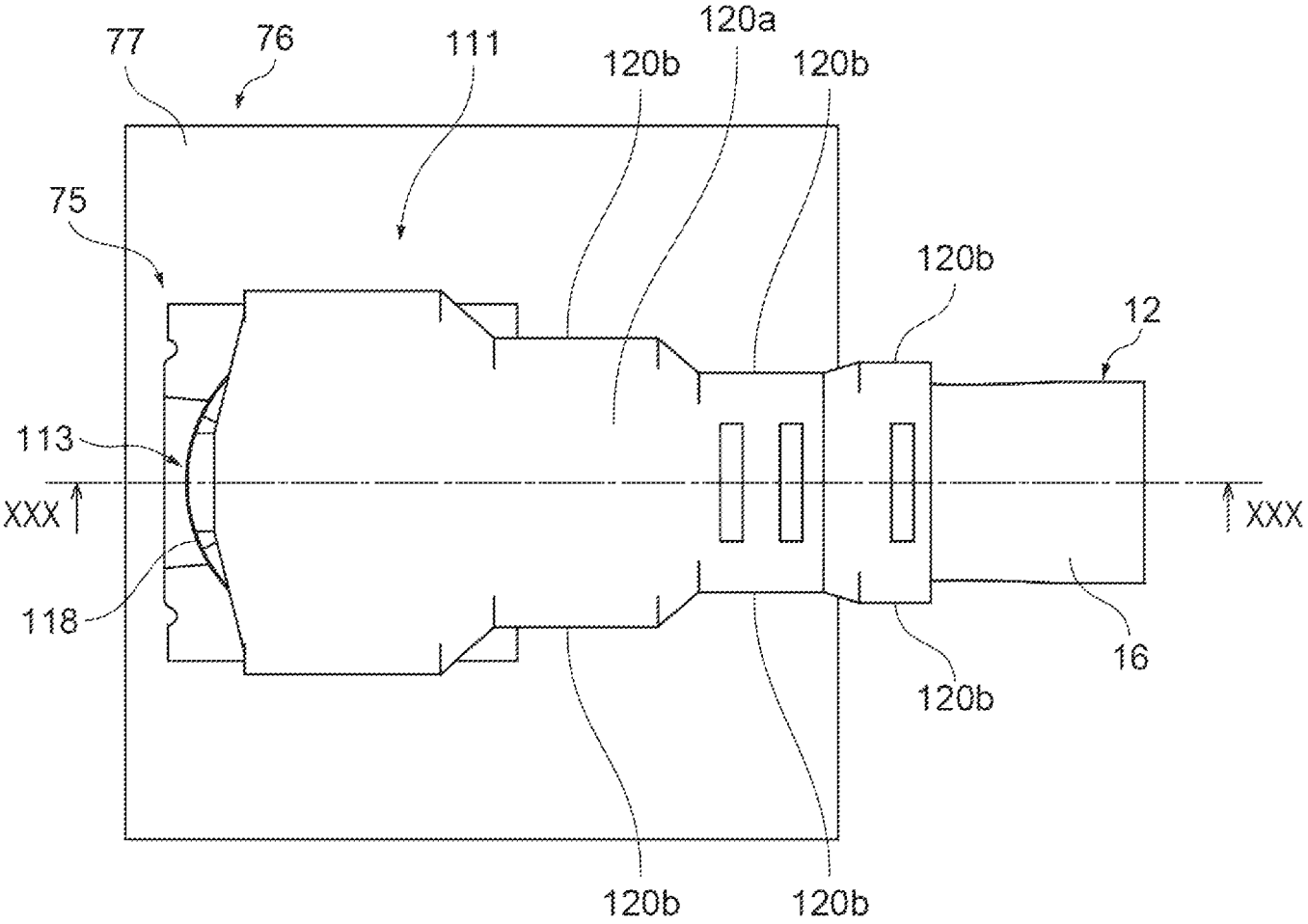
FIG. 29 is a plan view illustrating a state in which an example coaxial connector device according to the present disclosure is mounted on the one end of the coaxial cable, an example mate connector device is mounted on a circuit board, and the example coaxial connector device is mechanically and electrically connected to the example mate connector device.
Figure 30:
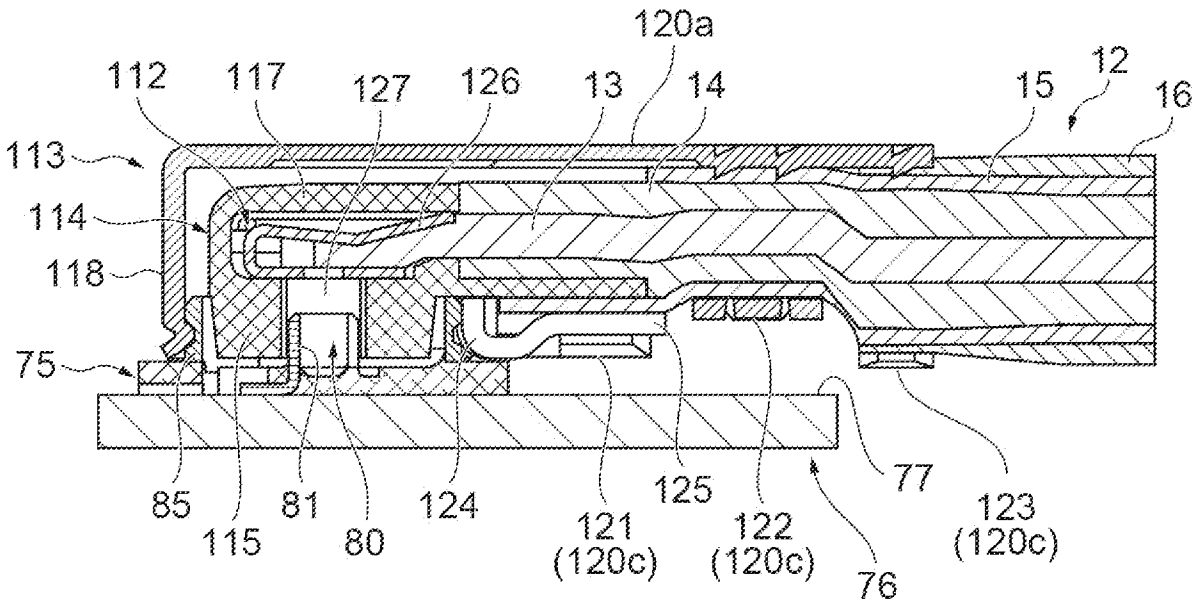
FIG. 30 is a cross-sectional view taken along line XXX-XXX in FIG. 29.

The coaxial connector device 111 illustrated in FIGS. 24, 25, 27, and 28 is attached to one end of the coaxial cable 12. FIGS. 29 and 30 illustrate a state in which the coaxial connector device 111 illustrated in FIGS. 24, 25, 27, and 28 is connected to the mate connector device 75. The coaxial connector device 111 mounted at one end of the coaxial cable 12 is connected to the mate connector device 75. The annular fitting portion 118 of the ground contact member 113 of the coaxial connector device 111 is fit and connected to the ground contact portion 85 of the mate connector device 75. At the same time, the first conductive portion 124 of the coaxial connector device 111 is contacted and connected to the ground contact portion 85 of the mate connector device 75.

In this way, the coaxial connector device 111 is attached to one end of the coaxial cable 12. The annular fitting portion 118 of the ground contact member 113 of the coaxial connector device 111 is fit and connected to the ground contact portion 85 of the mate connector device 75. The first conductive portion 124 is contacted and connected to the ground contact portion 85 of the mate connector device 75. As illustrated in FIG. 30, the signal contact member 112 is supported by the insulating housing member 114 of the coaxial connector device 111. The center conductor connection portion 126 of the signal contact member 112 is connected to the center conductor 13 of the coaxial cable 12. The contact connection portion 127 of the signal contact member 112 is disposed inside the cylindrical portion 115 of the insulating housing member 114, and is contacted and connected to the contact connection portion 81 of the signal contact portion 80 of the mate connector device 75. Accordingly, the center conductor 13 of the coaxial cable 12 is connected to the signal terminal of the component mounting surface 77 of the circuit board 76 through the signal contact member 112 of the coaxial connector device 111 and the signal contact portion 80 of the mate connector device 75. In addition, the outer conductor 15 of the coaxial cable 12 is connected to the ground potential part of the circuit board 76 through the ground contact member 113 of the coaxial connector device 111 and the ground contact portion 85 of the mate connector device 75.

At this time, the first conductive portion 124 is disposed at a position to partially fill the opening OP3 of the annular fitting portion 118. The first conductive portion 124 is given ground potential through the ground contact portion 85 of the mate connector device 75. Inside the cylindrical portion 115 of the insulating housing member 114 of the coaxial connector device 111, the contact connection portion 127 of the signal contact member 112 of the coaxial connector device 111 is disposed. The cylindrical portion 115 is surrounded by the annular fitting portion 118 and the first conductive portion 124 of the ground contact member 113 of the coaxial connector device 111 given the ground potential. As a result, in the coaxial connector device 111, leakage of the radio frequency signal passing through the signal contact member 112 to the outside through the opening OP3 provided in the annular fitting portion 118 of the ground contact member 113 may be reduced. In addition, since at least a part of a portion between the annular fitting portion 118 and the bent engagement portion 121 is filled by the second conductive portion 125, leakage of the radio frequency signal between the annular fitting portion 118 and the bent engagement portion 121 may be reduced.

Figure 31:
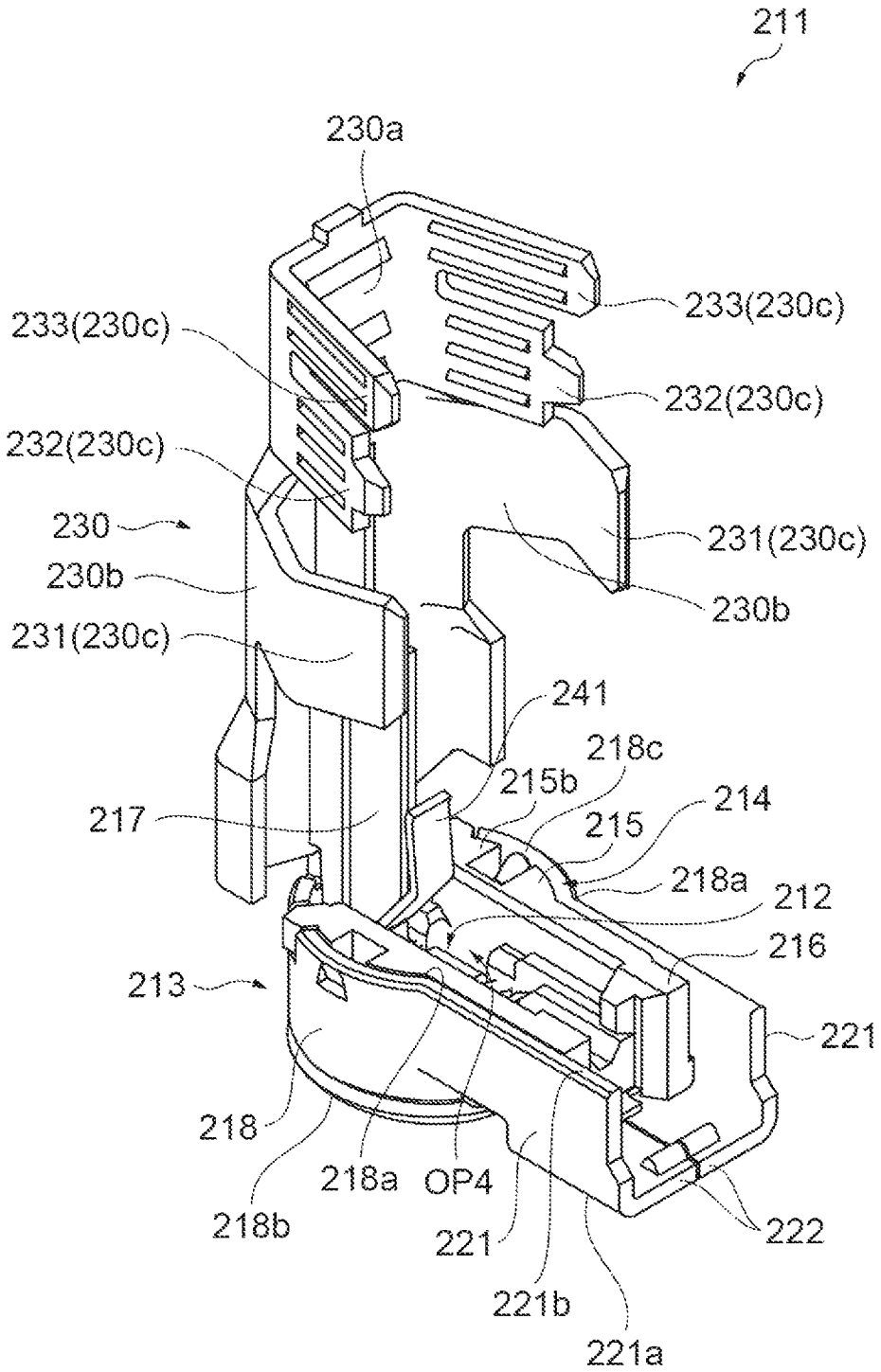
FIG. 31 is a perspective view illustrating an example coaxial connector device according to the present disclosure.

FIG. 31 illustrates a coaxial connector device 211 constituting an example a coaxial connector device according to the present disclosure. The coaxial connector device 211 includes a signal contact member 212, a ground contact member 213, and an insulating housing member 214 as main constituent element. The signal contact member 212 is formed of an elastic conductive material and is electrically connected to the center conductor 13 of the coaxial cable 12. The ground contact member 213 is formed of an elastic conductive material and is electrically connected to the outer conductor 15 of the coaxial cable 12. The insulating housing member 214 is formed of an insulating material such as a synthetic resin material and supports the signal contact member 212 and the ground contact member 213 in a mutually insulated state.

The insulating housing member 214 is provided with a cylindrical portion 215 and a center conductor support 216. The cylindrical portion 215 holds the signal contact member 212. The center conductor 13 of the coaxial cable 12 is connected to the signal contact member 212. The center conductor support 216 extends from the cylindrical portion 215 and supports the center conductor 13 of the coaxial cable 12 through the signal contact member 212. A bent contact portion 217 which is foldable extends from one end of the cylindrical portion 215. The bent contact portion 217 is folded and pressed against the signal contact member 212.

The ground contact member 213 has an annular fitting portion 218. The annular fitting portion 218 partially surrounds the cylindrical portion 215 of the insulating housing member 214. An opening OP4 is formed in the annular fitting portion 218. The opening OP4 is sandwiched by a pair of ends 218*a* of the annular fitting portion 218 that face each other. The cylindrical portion 215 of the insulating housing member 214 and the annular fitting portion 218 of the ground contact member 213 partially surrounding the cylindrical portion 215 constitute a fitting connection portion in the coaxial connector device 211. The coaxial connector device 211 mounted at one end of the coaxial cable 12 is fitted and connected to a mate connector device, which is another connector device, by the fitting connection portion. Hereinafter, a state in which the coaxial connector device 211 is fittingly connected to the mate connector device is referred to as a "fittingly connected state". In the fittingly connected state, the annular fitting portion 218 is fit and connected to the ground contact portion of the mate connector device. The cylindrical portion 215 has a first end surface 215*a* facing the mate connector device in the fittingly connected state and a second end surface 215*b* facing away from the mate connector device in the fittingly connected state. The annular fitting portion 218 has a first edge 218*b* oriented in the same direction as the first end surface 215*a* and a second edge 218*c* oriented in the same direction as the second end surface 215*b*. The center conductor support 216 has a first surface 216*a* oriented in the same direction as the first end surface 215*a*, a second surface 216*b* oriented in the same direction as the second end surface 215*b*, and a pair of side surfaces 216*c* perpendicular to the first surface 216*a* and the second surface 216*b*.

From the pair of ends 218*a* of the annular fitting portion 218, a pair of arm portions 221 extending along the center conductor support 216 of the insulating housing member 214 extend, respectively. The pair of arm portions 221 each cover at least a portion of the pair of side surfaces 216*c*. An arm portion 221 has a first edge 221*a* oriented in the same direction as the first end surface 215*a* of the cylindrical portion 215 and a second edge 221*b* oriented in the same direction as the second end surface 215*b* of the cylindrical portion 215. From the first edge 221*a* of each the arm portion 221, an inner clamping portion 222 projects toward the other the arm portion 221. The inner clamping portion 222 covers at least a portion of the first surface 216*a* of the center conductor support 216. The ends of a pair of inner clamping portions 222 projecting from the pair of arm portions 221 face each other at the center of the first surface 216*a*.

Figure 32:
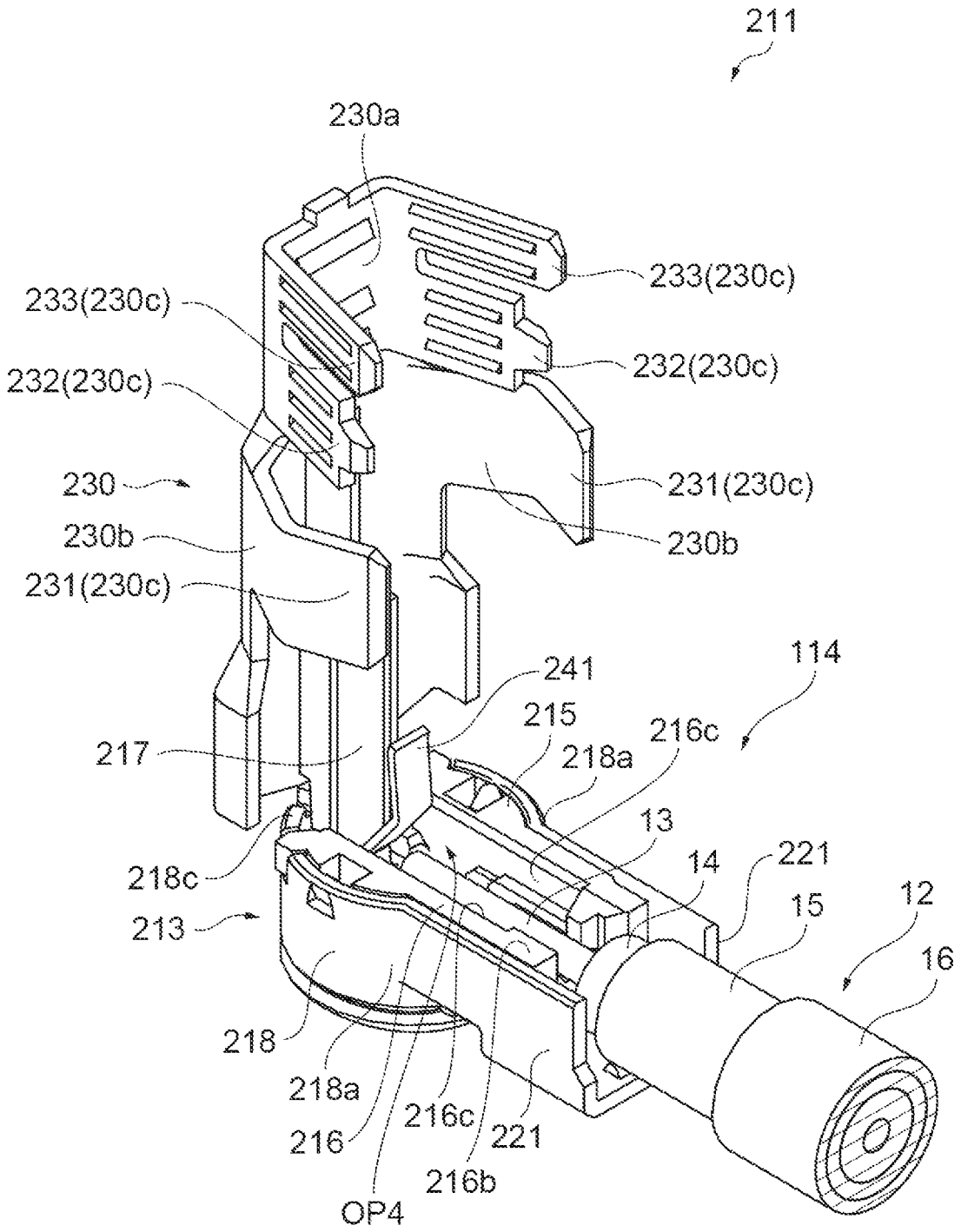
FIG. 32 is a perspective view illustrating a process in which an example coaxial connector device according to the present disclosure is mounted on one end of a coaxial cable.

The ground contact member 213 has, in addition to the annular fitting portion 218, a shell portion 230 extending from the second edge 218*c* of the annular fitting portion 218 in a foldable manner. The shell portion 230 is connected to the outer conductor 15 of the coaxial cable 12 when folded from the second edge 218*c*. The center conductor 13 of the coaxial cable 12 is connected to the signal contact member 212. The shell portion 230 of the ground contact member 213 is configured to be selectively positioned in an unfolded upright position relative to the annular fitting portion 218 and in a folded bent position relative to the annular fitting portion 218. In FIGS. 31 and 32, the shell portion 230 of the ground contact member 213 is disposed at the upright position, and in FIGS. 33 to 35 described later, the shell portion 230 of the ground contact member 213 is disposed at the bent position. Hereinafter, the case where the shell portion 230 is in the bent position will be described. The shell portion 230 is located outside the annular fitting portion 218 (outside a virtual circle along the outer periphery of the annular fitting portion 218) and accommodates at least a part of the end of the insulating housing member 214 (end of the center conductor support 216) and the end of the coaxial cable 12. The opening OP4 (the opening between the pair of ends 218*a*) of the annular fitting portion 218 couples the inside of the annular fitting portion 218 with the inside of the shell portion 230.

The shell portion 230 includes a base plate 230*a* and a pair of side plates 230*b*. The base plate 230*a* covers at least a portion of the second end surface 215*b* of the cylindrical portion 215. The base plate 230*a* extends out of the annular fitting portion 218 and further covers at least a portion of the second surface 216*b* of the center conductor support 216. The pair of side plates 230*b* is provided in a portion of the base plate 230*a* that protrudes outside the annular fitting portion 218. The pair of side plates 230*b* stand from the base plate 230*a* in the same direction as the first surface 216*a* of the center conductor support 216 and face each other. Each a side plate 230*b* sandwiches the arm portion 221 with the center conductor support 216.

The end of the pair of side plates 230*b* is provided with a pair of outer clamping portions 230*c* that is bent to hold the end of the insulating housing member 214 and the end of the coaxial cable 12 in the shell portion 230. For example, an outer clamping portion 230*c* holds the end of the insulating housing member 214 and the end of the coaxial cable 12 in cooperation with the base plate 230*a*. In detail, the outer clamping portion 230*c* has an end of the insulating housing member 214 and an end of the coaxial cable 12 interposed between the outer clamping portion 230*c* and the base plate 230*a*. Each the outer clamping portion 230*c* has a first bent engagement portion 231, a second bent engagement portion 232, and a third bent engagement portion 233 arranged in order in a direction away from the annular fitting portion 218. As illustrated particularly in FIGS. 33, 34, and 38, a bent engagement portion 231 engages the end of the insulating housing member 214 via the inner clamping portion 222. A bent engagement portion 232 engages the exposed the outer conductor 15 at the end of the coaxial cable 12. Thus, the ground contact member 213 is connected to the outer conductor 15. A bent engagement portion 233 engages the surface insulator 16 at the end of the coaxial cable 12.

The signal contact member 212 in the coaxial connector device 211 has a center conductor connection portion 241 and a contact connection portion 242 (contact portion). The contact connection portion 242 appears in FIG. 34. The center conductor connection portion 241 is provided so as to be bendable in a substantially L-shape, and is brought into contact with and connected to the center conductor 13 of the coaxial cable 12 when bent. The contact connection portion 242 extends from the portion of the signal contact member 212 where the center conductor connection portion 241 is provided. The contact connection portion 242 is located in the cylindrical portion 215 of the insulating housing member 214 partially surrounded by the annular fitting portion 218 of the ground contact member 213.

Figure 34:
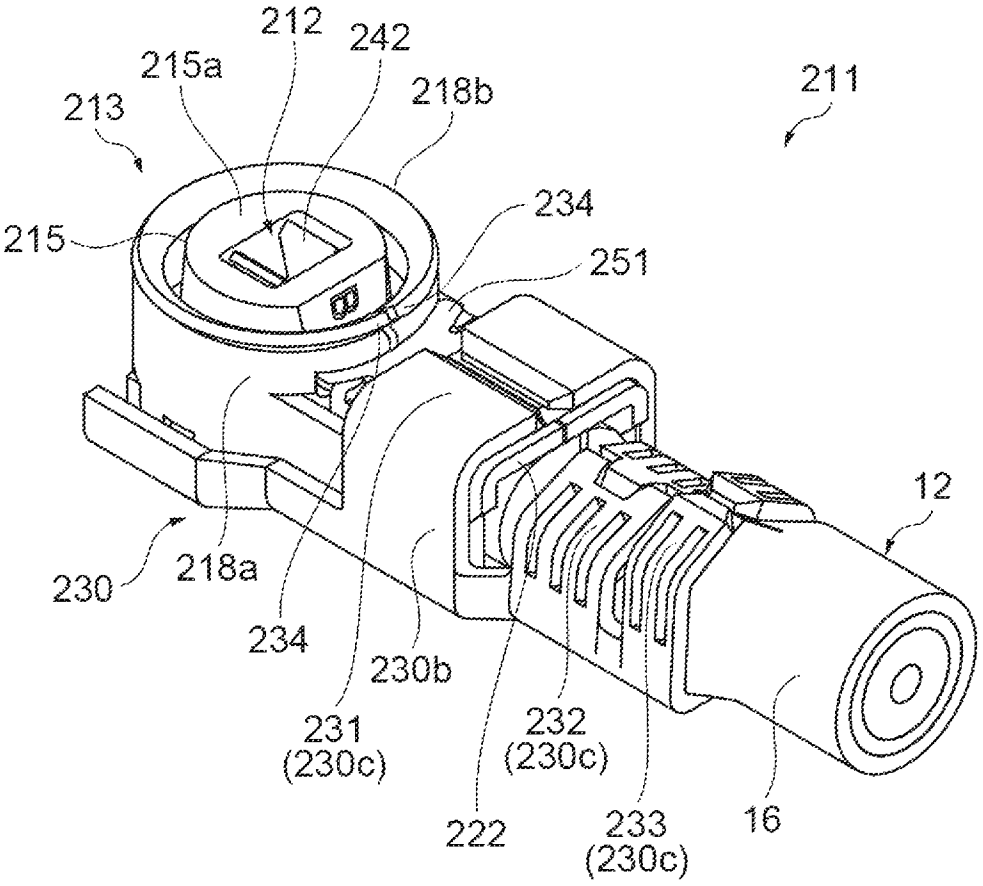
FIG. 34 is a perspective view illustrating a state in which an example coaxial connector device according to the present disclosure is mounted on the one end of the coaxial cable, as viewed from below.

As illustrated in FIG. 34, the ground contact member 213 in the coaxial connector device 211 has a first conductive portion 234. The first conductive portion 234 fills at least a part of the opening OP4 and surrounds the contact connection portion 242 together with the annular fitting portion 218 (surrounds the cylindrical portion 215). The first conductive portion 234 is secured to (or extends from) the annular fitting portion 218. For example, the coaxial connector device 211 has a pair of first conductive portions 234 secured to the pair of ends 218*a* of the annular fitting portion 218. The pair of first conductive portions 234 is integrally formed with the annular fitting portion 218 by one plate material. The pair of first conductive portions 234 protrudes from the pair of ends 218*a* along the imaginary circle to the center of the opening OP4.

Figure 35:
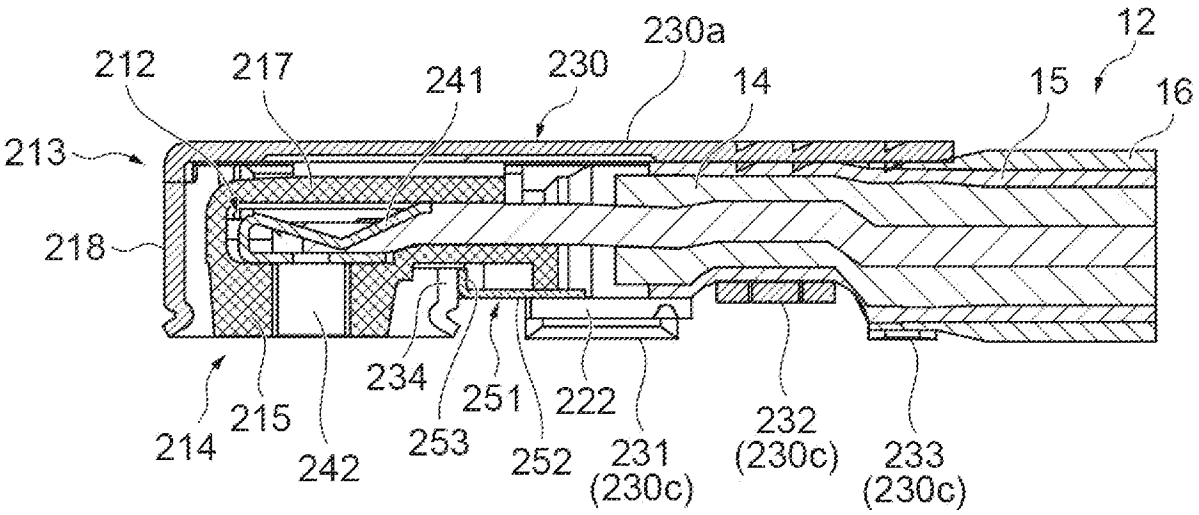
FIG. 35 is a cross-sectional view taken along line XXXV-XXXV in FIG. 33.
Figure 36:
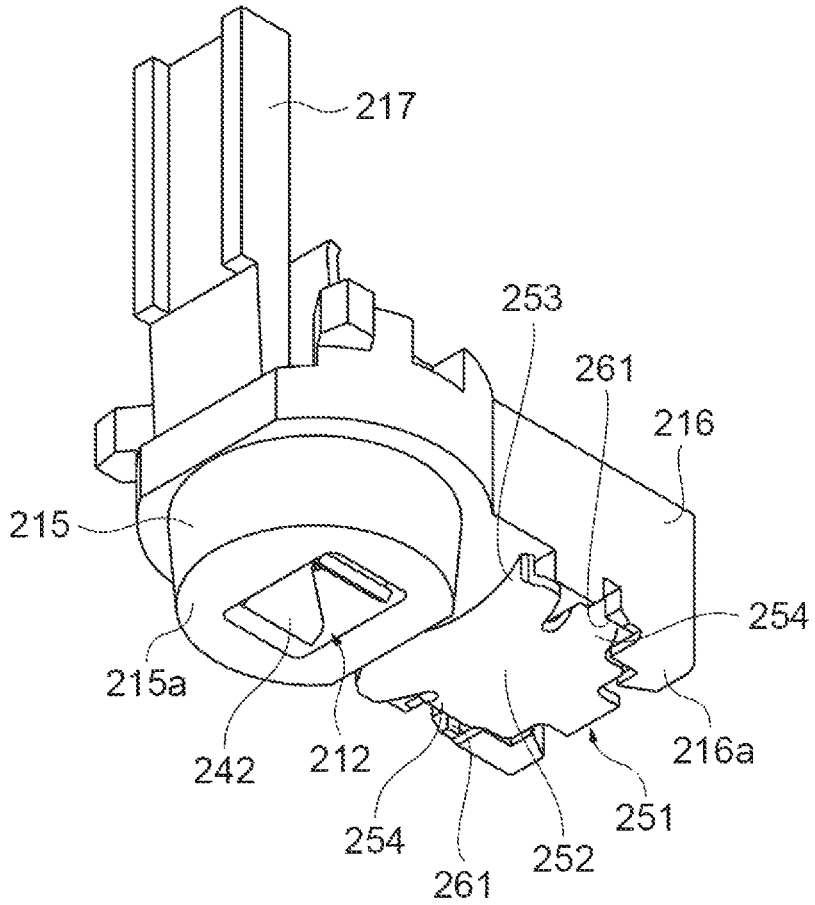
FIG. 36 is a perspective view of a housing as viewed from below.
Figure 37:
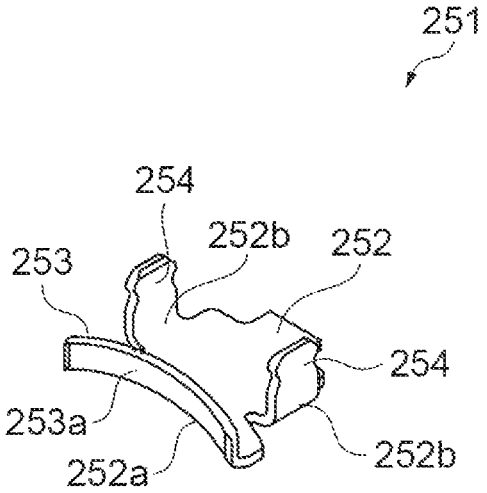
FIG. 37 is a perspective view of a conductive member as viewed from above.

As illustrated in FIG. 36, in the insulating housing member 214, a conductive member 251 (second conductive portion) is attached to the first surface 216*a* of the center conductor support 216. The conductive member 251 is formed of an elastic conductive material. The conductive member 251 is formed, for example, by punching and bending a metallic plate. As illustrated in FIG. 37, the conductive member 251 includes a base plate 252, a contact portion 253, and a pair of claw portions 254. The base plate 252 includes an end 252*a* recessed in an arc shape and two side portion 252*b* intersecting the end 252*a*. The contact portion 253 is provided in the end 252*a* and stands vertically to the base plate 252. The contact portion 253 is curved in an arc shape along the end 252*a* and constitutes a concave a contact surface 253*a*. The radius of curvature of the contact surface 253*a* is equivalent to the radius of curvature of the outer surface of the first conductive portion 234 (the outer surface of the annular fitting portion 218). The pair of claw portions 254 is provided in each of the two side portions 252*b*, and stand in the same direction as the contact portion 253 with respect to the base plate 252. The conductive member 251 is disposed such that the contact surface 253*a* faces the cylindrical portion 215 and is secured to the center conductor support 216. The center conductor support 216 is provided with two insertion holes 261 opened to the first surface 216*a*, and the pair of claw portions 254 is inserted into each of the two insertion holes 261. The contact portion 253 of the conductive member 251 secured to the center conductor support 216 contacts the pair of first conductive portions 234, and the base plate 252 contacts the pair of inner clamping portions 222 (see FIG. 35).

When the coaxial connector device 211 as described above is attached to one end of the coaxial cable 12, first, as illustrated in FIG. 32, at one end of the coaxial cable 12, the surface insulator 16 is partially excised to expose the outer conductor 15. Each of the outer conductor 15 and the internal insulator 14 is partially excised to expose the center conductor 13. The center conductor 13 of the coaxial cable 12 with one end is placed on the center conductor support 216 of the insulating housing member 214 with the shell portion 230 of the ground contact member 213 in an upright position.

Thereafter, the shell portion 230 is folded against the annular fitting portion 218 of the ground contact member 213 and placed in a bent position. In the center conductor support 216 in the insulating housing member 214, the center conductor 13 of the coaxial cable 12 is placed. The bent contact portion 217 of the insulating housing member 214 is bent along with the bending of the shell portion 230, abuts on the center conductor connection portion 241 of the signal contact member 212, moves the center conductor connection portion 241 so as to push it toward the center conductor 13 of the coaxial cable 12, and presses the center conductor connection portion 241 against the center conductor 13 of the coaxial cable 12. Thus, the center conductor 13 of the coaxial cable 12 is mechanically and electrically connected to the center conductor connection portion 241 of the signal contact member 212. At this time, the center conductor 13 of the coaxial cable 12 connected to the center conductor connection portion 241 of the signal contact member 212 extends from the center conductor support 216 of the insulating housing member 214 through the opening OP4 of the annular fitting portion 218 of the ground contact member 213 into the cylindrical portion 215 of the insulating housing member 214. The center conductor 13 of the coaxial cable 12 connected to the center conductor connection portion 241 of the signal contact member 212 is disposed in the opening OP4.

Figure 33:
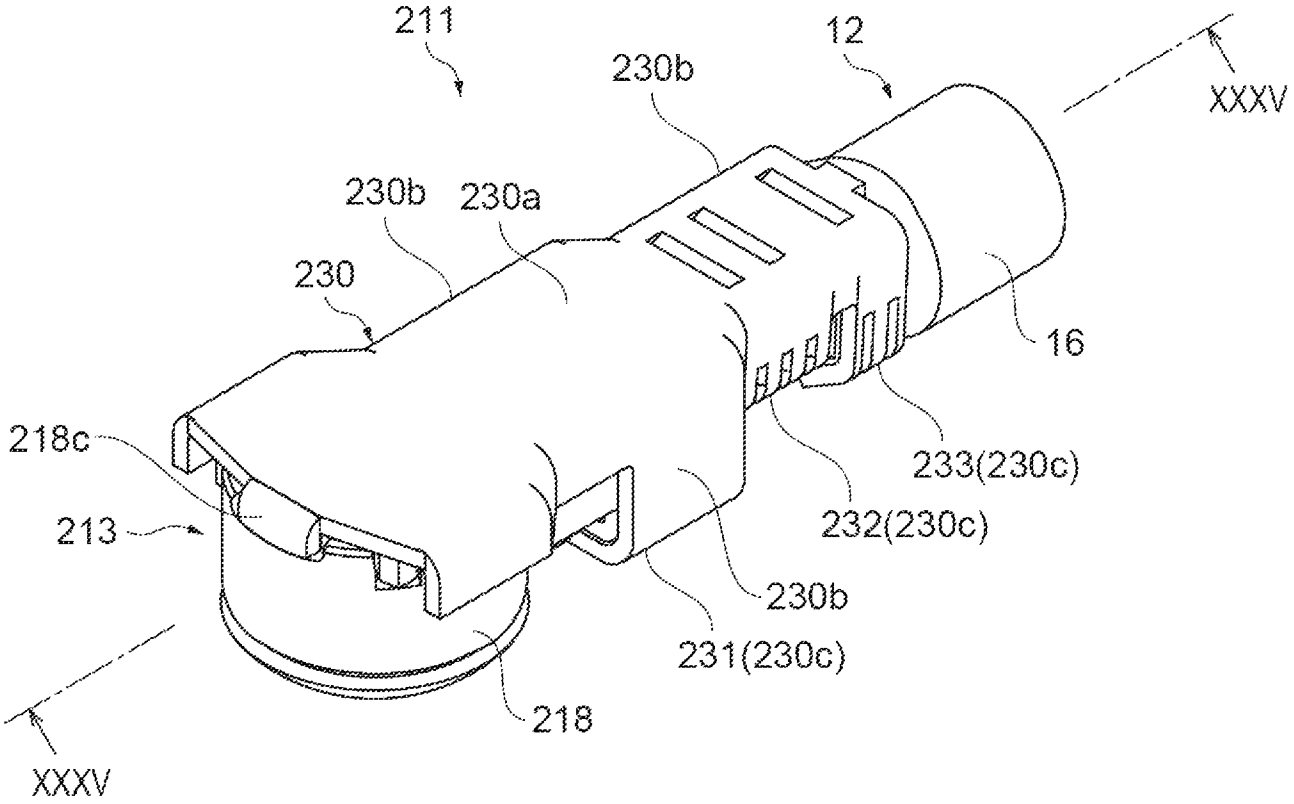
FIG. 33 is a perspective view illustrating a state in which an example coaxial connector device according to the present disclosure is mounted on the one end of the coaxial cable, as viewed from above.

Thereafter, in the shell portion 230 disposed at the bending position, a pair of first bent engagement portions 231, a pair of bent engagement portions 232, and a pair of bent engagement portions 233 are bent, and the end of the insulating housing member 214 and the end of the coaxial cable 12 are held in the shell portion 230. Each of a pair of bent engagement portions 231 is engaged to the center conductor support 216 of the insulating housing member 214 via the inner clamping portion 222. Thus, the center conductor support 216 is held in the shell portion 230 by the inner clamping portion 222 and the bent engagement portion 231. Further, the bent engagement portion 231 and the conductive member 251 are electrically connected via the inner clamping portion 222 (see FIGS. 34 and 35). Each of the pair of bent engagement portions 232 is engaged with the outer conductor 15 of the coaxial cable 12. The center conductor 13 of the coaxial cable 12 is connected to the center conductor connection portion 241 of the signal contact member 212. Each of a pair of third bent engagement portions 233 is engaged with the surface insulator 16 of the coaxial cable 12. Thereby, the shell portion 230 of the ground contact member 213 is connected to the outer conductor 15 of the coaxial cable 12. As a result, as illustrated in FIGS. 33, 34, and 35, the state in which the coaxial connector device 211 is mounted on one end of the coaxial cable 12 is firmly maintained. FIG. 33 is a perspective view of the coaxial connector device 211 attached to one end of the coaxial cable 12 as viewed from above, FIG. 34 is a perspective view of the coaxial connector device 211 attached to one end of the coaxial cable 12 as viewed from below, and FIG. 35 is a sectional view taken along line XXXV-XXXV in FIG. 33.

Figure 38:
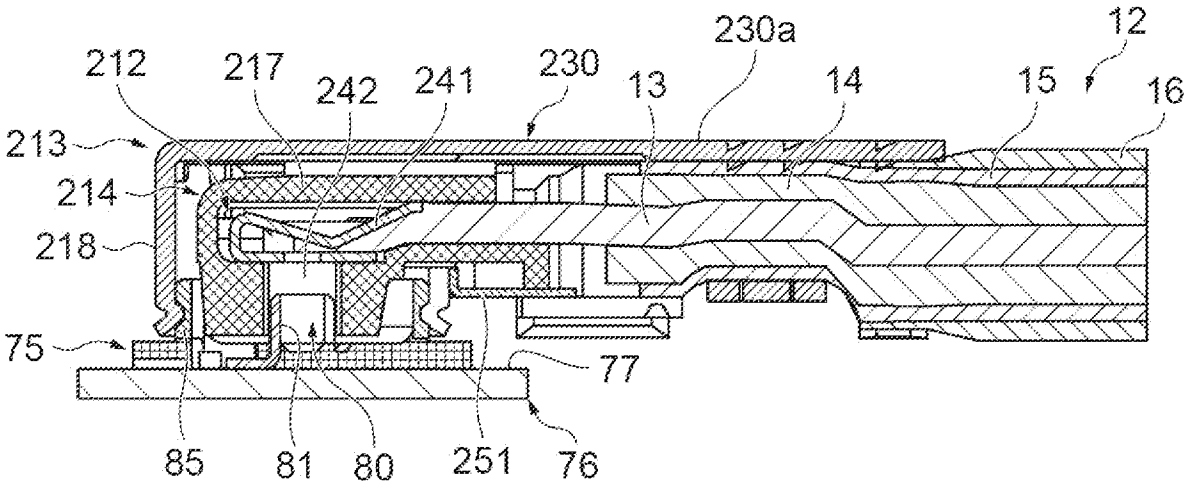
FIG. 38 is a cross-sectional view illustrating a state in which an example coaxial connector device according to the present disclosure is mounted on the one end of the coaxial cable, an example mate connector device is mounted on a circuit board, and the example coaxial connector device is mechanically and electrically connected to the example mate connector device.

FIG. 38 illustrates a state in which the coaxial connector device 211 illustrated in FIGS. 33, 34, and 35 is connected to the mate connector device 75. The coaxial connector device 211 mounted at one end of the coaxial cable 12 is connected to the mate connector device 75. The annular fitting portion 218 of the ground contact member 213 of the coaxial connector device 211 is fit and connected to the ground contact portion 85 of the mate connector device 75. At the same time, the first conductive portion 234 of the coaxial connector device 211 is contacted and connected to the ground contact portion 85 of the mate connector device 75.

In this way, the coaxial connector device 211 is attached to one end of the coaxial cable 12. The annular fitting portion 218 of the ground contact member 213 of the coaxial connector device 211 is fit and connected to the ground contact portion 85 of the mate connector device 75. The first conductive portion 234 is contacted and connected to the ground contact portion 85 of the mate connector device 75. The signal contact member 212 is supported by the insulating housing member 214 of the coaxial connector device 211. The center conductor connection portion 241 of the signal contact member 212 is connected to the center conductor 13 of the coaxial cable 12. The contact connection portion 242 of the signal contact member 212 is disposed inside the cylindrical portion 215 of the insulating housing member 214, and is contacted and connected to the contact connection portion 81 of the signal contact portion 80 of the mate connector device 75. Accordingly, the center conductor 13 of the coaxial cable 12 is connected to the signal terminal of the component mounting surface 77 of the circuit board 76 through the signal contact member 212 of the coaxial connector device 211 and the signal contact portion 80 of the mate connector device 75. In addition, the outer conductor 15 of the coaxial cable 12 is connected to the ground potential part of the circuit board 76 through the ground contact member 213 of the coaxial connector device 211 and the ground contact portion 85 of the mate connector device 75.

At this time, the first conductive portion 234 is disposed at a position to partially fill the opening OP4 of the annular fitting portion 218. The first conductive portion 234 is given ground potential through the ground contact portion 85 of the mate connector device 75. Inside the cylindrical portion 215 of the insulating housing member 214 of the coaxial connector device 211, the contact connection portion 242 of the signal contact member 212 of the coaxial connector device 211 is disposed. The cylindrical portion 215 is surrounded by the annular fitting portion 218 and the first conductive portion 234 of the ground contact member 213 of the coaxial connector device 211 given the ground potential. As a result, in the coaxial connector device 211, leakage of the radio frequency signal passing through the signal contact member 212 to the outside through the opening OP4 of the annular fitting portion 218 of the ground contact member 213 may be reduced. In addition, since at least a part of a portion between the annular fitting portion 218 and the inner clamping portion 222 is filled by the conductive member 251, leakage of the radio frequency signal between the annular fitting portion 218 and the inner clamping portion 222 may be reduced.

Although various examples have been described above, the present disclosure is not limited to these examples, and can be variously changed without departing from the gist thereof. For example, the first conductive portion may be secured to (or extend from) the annular fitting portion and the second conductive portion may be secured to (or extend from) the clamping portion and contact the first conductive portion.

Although certain procedures or operations are described herein as being performed sequentially or in a particular order, in some examples one or more of the operations may be performed in a different order, in parallel, simultaneously with each other, or in an overlapping manner. Additionally, in some examples, one or more of the operations may be optionally performed or, in some cases, omitted altogether.

We claim all modifications and variations coming within the spirit and scope of the subject matter claimed herein.

What is claimed is:

1. A coaxial connector device comprising: a conductive signal contact member; a conductive ground contact member; and an insulating housing member holding the signal contact member and accommodated in the ground contact member, wherein the signal contact member comprises:

a connection portion configured to be connected to a center conductor of a coaxial cable; and a contact portion configured to contact a signal contact portion of a mate connector device, wherein the ground contact member comprises:

an annular fitting portion accommodating the contact portion and configured to be fitted to a ground contact portion of the mate connector device;

a shell portion configured to accommodate at least a part of an end of the insulating housing member and an end of the coaxial cable outside the annular fitting portion;

a clamping portion configured to retain at least an end of the insulating housing member within the shell portion;

an opening provided in the annular fitting portion and coupling an interior of the annular fitting portion with an interior of the shell portion;

a first conductive portion configured to:

fill at least a part of the opening to surround the contact portion with the annular fitting portion; and contact the ground contact portion when the annular fitting portion fits the ground contact portion; and a second conductive portion configured to:

fill at least a part of a gap between the first conductive portion and the clamping portion; and electrically connect the first conductive portion to the clamping portion, wherein the first conductive portion and the second conductive portion are integrally formed with the annular fitting portion, the shell portion, and the clamping portion.

2. The coaxial connector device according to claim 1, wherein the first conductive portion, the second conductive portion, the annular fitting portion, the shell portion, and the clamping portion are integrally formed of a metal plate.

3. The coaxial connector device according to claim 1, wherein the first conductive portion and the second conductive portion extend from the clamping portion.

4. The coaxial connector device according to claim 3, wherein the second conductive portion extends from the clamping portion toward the annular fitting portion, and wherein the first conductive portion is bent with respect to the second conductive portion.

5. The coaxial connector device according to claim 1, wherein the first conductive portion and the second conductive portion extend from the annular fitting portion, and wherein the second conductive portion contacts the clamping portion.

6. The coaxial connector device according to claim 5, wherein the clamping portion clamps the insulating housing member with the second conductive portion to contact the second conductive portion.

7. The coaxial connector device according to claim 1, wherein the first conductive portion extends from the annular fitting portion, and wherein the second conductive portion extends from the clamping portion toward the annular fitting portion to contact the first conductive portion.

8. A connector system comprising:

the coaxial connector device according to claim 1; and the mate connector device.

9. The connector system according to claim 8, wherein the first conductive portion and the second conductive portion extend from the clamping portion.

10. The connector system according to claim 8, wherein the first conductive portion and the second conductive portion extend from the annular fitting portion, and wherein the second conductive portion contacts the clamping portion.

11. The connector system according to claim 8, wherein the first conductive portion extends from the annular fitting portion, and wherein the second conductive portion extends from the clamping portion toward the annular fitting portion to contact the first conductive portion.

12. A coaxial connector device comprising: a conductive signal contact member; a conductive ground contact member; and an insulating housing member holding the signal contact member and accommodated in the ground contact member, wherein the signal contact member comprises:

a connection portion configured to be connected to a center conductor of a coaxial cable; and a contact portion configured to contact a signal contact portion of a mate connector device, wherein the ground contact member comprises:

an annular fitting portion accommodating the contact portion and configured to be fitted to a ground contact portion of the mate connector device;

a shell portion configured to accommodate at least a part of an end of the insulating housing member and an end of the coaxial cable outside the annular fitting portion;

a clamping portion configured to retain at least an end of the insulating housing member within the shell portion;

an opening provided in the annular fitting portion and coupling an interior of the annular fitting portion with an interior of the shell portion;

a first conductive portion configured to:

fill at least a part of the opening to surround the contact portion with the annular fitting portion; and contact the ground contact portion when the annular fitting portion fits the ground contact portion; and a second conductive portion configured to:

fill at least a part of a gap between the first conductive portion and the clamping portion; and electrically connect the first conductive portion to the clamping portion, wherein the second conductive portion is formed separately from the annular fitting portion, the shell portion, and the clamping portion, and wherein the second conductive portion is secured to the insulating housing member.

13. The coaxial connector device according to claim 12, wherein the clamping portion clamps the insulating housing member with the second conductive portion to contact the second conductive portion.

14. The coaxial connector device according to claim 12, wherein the first conductive portion is formed separately from the annular fitting portion, the shell portion, and the clamping portion, and wherein the first conductive portion is integrally formed with the second conductive portion.

15. The coaxial connector device according to claim 14, wherein the second conductive portion extends to fill the gap, and wherein the first conductive portion is bent with respect to the second conductive portion.

16. The coaxial connector device according to claim 15, wherein the second conductive portion extends to fill the gap, and wherein the first conductive portion is bent to form an elastic contact portion configured to elastically contact the ground contact portion when the annular fitting portion fits the ground contact portion.

17. The coaxial connector device according to claim 12, wherein the first conductive portion extends from the annular fitting portion, and wherein the second conductive portion contacts the first conductive portion.

18. A connector system comprising:

the coaxial connector device according to claim 12; and the mate connector device.

19. The connector system according to claim 18, wherein the first conductive portion is formed separately from the annular fitting portion, the shell portion, and the clamping portion, and wherein the first conductive portion is integrally formed with the second conductive portion.

20. The connector system according to claim 18, wherein the first conductive portion extends from the annular fitting portion, and wherein the second conductive portion contacts the first conductive portion.

* * * * *